US012442085B2

(12) United States Patent
Shimizu et al.

(10) Patent No.: US 12,442,085 B2
(45) Date of Patent: Oct. 14, 2025

(54) SURFACE-TREATED STEEL SHEET

(71) Applicant: NIPPON STEEL CORPORATION, Tokyo (JP)

(72) Inventors: Atsuo Shimizu, Tokyo (JP); Ikumi Tokuda, Tokyo (JP); Hiromasa Shoji, Tokyo (JP); Koji Akioka, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 293 days.

(21) Appl. No.: 18/254,958

(22) PCT Filed: Jan. 6, 2022

(86) PCT No.: PCT/JP2022/000228
§ 371 (c)(1),
(2) Date: May 30, 2023

(87) PCT Pub. No.: WO2022/149596
PCT Pub. Date: Jul. 14, 2022

(65) Prior Publication Data

US 2024/0044013 A1 Feb. 8, 2024

(30) Foreign Application Priority Data

Jan. 6, 2021 (JP) ..... 2021-001011

(51) Int. Cl.
*C23C 28/00* (2006.01)
*C23C 2/06* (2006.01)
(Continued)

(52) U.S. Cl.
CPC ..... *C23C 28/321* (2013.01); *C23C 2/06* (2013.01); *C23C 2/26* (2013.01); *C23C 2/40* (2013.01)

(58) Field of Classification Search
None
See application file for complete search history.

(56) References Cited

U.S. PATENT DOCUMENTS 5,897,948 A 4/1999 Sakon et al.
2009/0110921 A1 4/2009 Kaneto et al.
(Continued)

FOREIGN PATENT DOCUMENTS

JP 4776458 B2 9/2011
JP 6191806 B1 9/2017
(Continued)

OTHER PUBLICATIONS

Okai—JP 2020-066793 A—IDS—MT—coated steel—2020 (Year: 2020).*

*Primary Examiner* — John Vincent Lawler
(74) *Attorney, Agent, or Firm* — Renner, Otto, Boisselle & Sklar, LLP

(57) ABSTRACT

This surface-treated steel sheet includes: a steel sheet; a Zn-based plating layer formed on the steel sheet; and a coating formed on the Zn-based plating layer, in which a Si concentration, a P concentration, a F concentration, a V concentration, a Zr concentration, a Zn concentration, and an Al concentration of the coating are, by mass %, Si: 10.00% to 25.00%, P: 0.01% to 5.00%, F: 0.01% to 2.00%, V: 0.01% to 4.00%, Zr: 0.01% to 3.00%, Zn: 0% to 3.00%, and Al: 0% to 3.00%, in a narrow spectrum of 5i2p obtained by performing XP S analysis on a surface of the coating, a ratio of an integrated intensity of a peak having a local, maximum value, at 103.37±0.25 eV to an integrated intensity of a peak having a local maximum value at 102.26±0.25 eV is 0.04 or more and 0.25 or less.

6 Claims, 1 Drawing Sheet

(51) Int. Cl.
*C23C 2/26* (2006.01)
*C23C 2/40* (2006.01)

(56) References Cited

U.S. PATENT DOCUMENTS

| | | | | |
|---|---|---|---|---|
| 2016/0237572 | A1 | 8/2016 | Iwamizu et al. | |
| 2019/0010613 | A1* | 1/2019 | Shoji | B05D 3/0254 |
| 2022/0145473 | A1* | 5/2022 | Shoji | C22C 18/00 |

FOREIGN PATENT DOCUMENTS

| | | | | | |
|---|---|---|---|---|---|
| JP | 6272207 | B2 | | 1/2018 | |
| JP | 2020066793 | A | * | 4/2020 | C23C 22/07 |
| WO | 97/00337 | A1 | | 1/1997 | |
| WO | 2010070729 | A1 | | 6/2010 | |
| WO | 2019/225765 | A1 | | 11/2019 | |
| WO | 2020/189769 | A1 | | 9/2020 | |

* cited by examiner

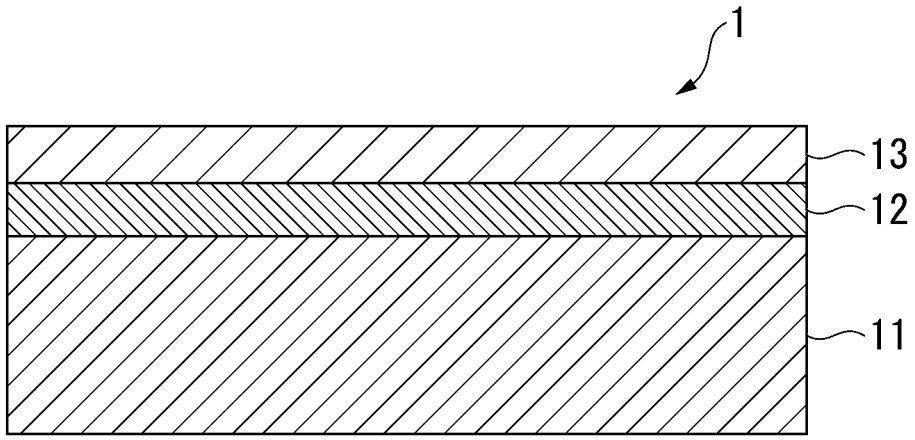
1
13
12
11

SURFACE-TREATED STEEL SHEET

TECHNICAL FIELD OF THE INVENTION

The present invention relates to a surface-treated steel sheet. Priority is claimed on Japanese Patent Application No. 2021-001011 filed Jan. 6, 2021, the content of which is incorporated herein by reference.

BACKGROUND ART

In the related art, a plated steel sheet (zinc-based plated steel sheet) in which a plating layer primarily containing zinc is formed on a surface of a steel sheet has been used in a wide range of applications such as vehicles, building materials, and home appliances. Usually, the surface of the plated steel sheet is subjected to a chromium free chemical conversion treatment in order to impart further corrosion resistance without being oiled.

A chemical conversion coating formed by this chemical conversion treatment is required to uniformly cover the surface, have excellent adhesion to plating, and have excellent corrosion resistance. However, since the surface of the zinc-based plated steel sheet is covered with an oxide coating, even if an attempt is made to form a chemical conversion coating, the oxide coating acting as an obstacle causes low adhesion of the chemical conversion coating, and there are cases where coating defects and coating unevenness occurs due to a decrease in the adhesion of the chemical conversion coating, or the chemical conversion coating is peeled off from the plating layer.

In order to solve such a problem, for example, Patent Document 1 discloses that a film having good adhesion to an adhesive and having excellent corrosion resistance can be obtained by forming, on a plated steel sheet containing zinc, a film in which an acrylic resin, zirconium, vanadium, phosphorus, and cobalt are contained, an area ratio of the acrylic resin in a region from a surface in a cross section of the film to ⅕ of a film thickness is 80 to 100 area %, and an area ratio of the acrylic resin in a region including a region from a film thickness center of the film to 1/10 of the film thickness on a surface side and a region from the film thickness center to 1/10 of the film thickness on a plating layer side is 5 to 50 area %.

Patent Document 2 discloses a surface-treated steel including a steel sheet and a resin-based chemical conversion coating, in, which the resin-based chemical conversion coating has a matrix resin and colloidal particles of a sparingly soluble chromate dispersed in the matrix resin in a weight ratio range of 50/1 to 1/1, and an average particle size of the colloidal particles dispersed in the matrix resin is less than 1 μm.

Patent Document 2 describes that this surface-treated steel is excellent in chromium elution resistance, SST (240 hr), corrosion resistance of a processed portion, and stability of a treatment liquid.

Patent Document 3 discloses a chemical conversion steel sheet including a Zn-based plated steel sheet having a Zn-based plating layer containing Al: 0.1 to 22.0 mass %, and a chemical conversion film disposed on the Zn-based plating layer, in which the chemical conversion film has a first chemical conversion layer that is disposed on a surface of the Zn-based plating layer and contains V, Mo, and P and a second chemical conversion layer that is disposed on the first chemical conversion layer and contains a group 4A metal oxyacid salt, and a ratio of pentavalent V to total V in the chemical conversion film is 0.7 or more.

Patent Document 3 discloses that this chemical conversion steel sheet is a chemical conversion steel sheet using the Zn-based plated steel sheet as a base sheet and can be manufactured even by drying an applied chemical conversion treatment liquid at a low temperature for a short period of time, <so that corrosion resistance and blackening resistance are excellent.

Patent Document 4 discloses a surface-treated steel in which, (1) onto a surface of a steel, (2) a surface treatment metal agent including an organic silicon compound (W) which is obtained by mixing a silane coupling agent (A) containing one amino group in a molecule and a silane coupling agent (B) containing one glycidyl group in a molecule in a solid content mass ratio [(A)/(B)] of 0.5 to 1.7, contains two or more functional groups (a) represented by the formula —$SiR^1R^2R^3$ (in the formula, $R^1$, $R^2$, and $R^3$ each independently represent an alkoxy group or a hydroxyl group, and at least one represents an alkoxy group) in a molecule and one or more of at least one hydrophilic functional group (b) selected from a hydroxyl group (separate from those that can be contained in the functional groups (a)) and an amino group, and has an average molecular weight of 1,000 to 10,000, (3) at least one fluoro compound (X) selected from hydroacid titanium fluoride or hydroacid zirconium fluoride, (4) a phosphoric acid (Y), and (5) a vanadium compound (Z) is applied and dried to form a composite film containing each component, and regarding each component of the composite film, (6) a solid content mass ratio [(X)/(W)] of the fluoro compound (X) to the organic silicon compound (W) is 0.02 to 0.07, (7) a solid content mass ratio [(Y)/(W)] of the phosphoric acid (Y) to the organic silicon compound (W) is 0.03 to 0.12, (8) a solid content mass ratio [(Z)/(X)] of the vanadium compound (Z) to the organic silicon compound (W) is 0.05 to 0.17, and (9) a solid content mass ratio [(Z)/(X)] of the vanadium compound (Z) to the fluoro compound (X) is 1.3 to 6.0.

According to Patent Document 4, it is disclosed that this surface-treated steel satisfies all of corrosion resistance, heat resistance, fingerprint resistance, conductivity, coatability, and black residue resistance during processing.

PRIOR ART DOCUMENT

Patent Document

[Patent Document 1] Japanese Patent No. 6191806
[Patent Document 2] PCT International Publication No. WO97/00337
[Patent Document 3] Japanese Patent No. 6272207
[Patent Document 4] Japanese Patent No. 4776458

DISCLOSURE OF THE INVENTION

Problems to be Solved by the Invention

However, in recent years, with the sophistication of quality requirements for chemical conversion coatings, better corrosion resistance and coating adhesion have been required, and there are cases where the techniques disclosed in Patent Documents 1 to 4 do not always satisfy the more sophisticated requirements.

Therefore, an object of the present invention is to provide a surface-treated steel sheet which is provided with a Zn-based plating laye and a coating and has excellent corrosion resistance (particularly white rust resistance) and coating adhesion.

In addition, in a case where a surface of the surface-treated steel shee (a surface of the coating) is coated, there are cases where alkaline degreasing is performed before coating. However, in the case of a surface-treated steel sheet having a coating (chemical conversion coating), when alkaline degreasing is performed, the coating is dissolved and wears, and there are cases where coating adhesion decreases.

Therefore, a preferable object of the present invention to provide a surface-treated steel sheet which is excellent in corrosion resistance and coating adhesion and is also excellent in coating adhesion after alkaline degreasing.

In addition, in a case where a chemical conversion coating primarily containing an organic silicon compound having a cyclic siloxane bond in the related art is used in an outdoor exposure environment, a C—C bond and a C—H bond contained in the organic silicon compound are broken by ultraviolet rays, and there are cases where corrosion resistance decreases.

Therefore, a preferable object of the present invention to provide a surface-treated steel sheet which is excellent in corrosion resistance and coating adhesion (including coating adhesion after alkaline degreasing) and does not decrease in corrosion resistance even in an outdoor exposure environment.

Means for Solving the Problem

The present inventors studied a method for improving corrosion resistance and coating adhesion in a surface-treated steel sheet provided with a Zn-based plating layer and a coating. As a result, it was found that by changing a portion of an organic silicon compound, which is a coating-forming component, to a silicon oxide compound on a surface of a coating, a barrier property of the coating is improved and corrosion resistance is improved.

In addition, the present inventors studied a method for enhancing resistance to an alkaline degreasing liquid. As a result, it was found that the resistance to the alkaline degreasing liquid is improved by increasing a Zn concentration on the surface of the coating.

In addition, the present inventors studied a method for suppressing a decrease in corrosion resistance in an outdoor exposure environment. As a result, it was found that fracture of the coating by ultraviolet rays is suppressed by increasing an Al concentration on the surface of the coating.

In addition, as a result of further studies by the present inventors, it was found that in addition to the control of the surface as described above, by distributing optimum components for components constituting a matrix of the coating in a cross-sectional direction, corrosion resistance and coating adhesion under stricter conditions can be improved while properties usually required, such as external appearance, are maintained as in the related art.

The present invention has been made in view of the above findings. The gist of the present invention is as follows.

[1] A surface-treated steel sheet according to an aspect of the present invention includes: a steel sheet; a Zn-based plating layer formed on the steel sheet; and a coating formed on the Zn-based plating layer, in which a Si concentration, a P concentration, a F concentration, a V concentration, a Zr concentration, a Zn concentration, and an Al concentration of the coating are, by mass %, Si: 10.00% to 25.00%, P: 0.01% to 5.00%, F: 0.01% to 2.00%, V: 0.01% to 4.00%, Zr: 0.01% to 3.00%, Zn: 0% to 3.00%, and Al:

0% to 3.00% in a narrow spectrum of Si2p obtained by performing XPS analysis on a surface, of the coating, a ratio of an integrated intensity of a peak having a local maximum value at 103.37±0.25 eV to an integrated intensity of a peak having a local maximum value at 102.26±0.25 eV is 0.04 or more and 0.25 or less.

[2] In the, surface-treated steel, sheet according to [1], in the surface of the coating, the Zn concentration may be 0.10% to 3.00% by mass %.

[3] In the surface-treated steel sheet according to [1] or [2], in the surface of the coating, the Al concentration may be 0.10% to 3.00% by masse.

[4] In the surface-treated steel sheet according to any one of [1] to [3], the coating may have a P-enriched layer having a P concentration higher than an average P concentration in a range from the surface of the coating to an interface between the coating and the Zn-based plating layer in a thickness direction of the steel sheet, the P-enriched layer may be present adjacent to the interface with the Zn-based plating layer, and when line analysis of TEM-EDS is performed on a cross section in the thickness direction to obtain the P concentration from the surface of the coating to the interface between the coating and the Zn-based plating layer, a ratio of a maximum value of the P concentration to the average P concentration may be 1.20 to 2.00.

[5] In the surface-treated steel sheet according to any one of [1] to [4] the coating may have a F-enriched layer having a F concentration higher than an average F concentration in a range from the surface of the coating to an interface between the coating and the Zn-based plating layer in a thickness direction of the steel sheet, the F-enriched layer may be present adjacent to the interface with the Zn-based plating layer, and when line analysis of TEM-EDS is performed on a cross section in the thickness direction to obtain the F concentration from the surface of the coating to the interface between the coating and the Zn-based plating layer, a ratio of a maximum value of the F concentration to the average F concentration may be 1.50 to 2.30.

[6] In the surface-treated steel sheet according to <any one of [1] to [5], the Zn-based plating layer may contain, as a chemical composition, by naass%, Al: 4.0% to less than 25.0%, Mg: 0% to less than 12.5%, Sn: 0% to 20%, Bi: 0% to less than 5.0%, In: 0% to less than 2.0%, Ca: 0% to 3.0%, Y: 0% to 0.5%, La: 0% to less than 0.5% Ce: 0% to less than 0.5%, Si: 0% to less than 2.5%, Cr: 0% to less than 0.25%, Ti: 0% to less than 0.25%, Ni: 0% to less than 0.25%, Co: 0% to less than 0.25%, V: 0% to less than 0.25% Nb: 0% to less than;0.25%, Cu: 0% to less than 0.25% Mn: 0% to less than 0.25%, Fe: 0% to 5.0%, Sr: 0% to less than 0.5%, Sb: 0% to less than 0.5%, Pb: 0% to less than 0.5%, B: 0% to less than 0.5%, and a remainder: Zn and impurities.

Effects of the Invention

According to the above aspect of the present invention, it is possible to provide a surface-treated steel sheet having excellent corrosion resistance and coating adhesion.

In addition, according to a preferred aspect of the, present invention, it is possible to provide a surface-treated steel sheet which is excellent in corrosion resistance and coating adhesion and is also excellent in coating adhesion after alkaline degreasing.

In addition, according to another preferable aspect of the present invention, it is possible to provide a surface-treated steel sheet which is excellent in corrosion resistance and coating adhesion and does not decrease in corrosion resistance even in an outdoor exposure environment.

BRIEF DESCRIPTION OF THE DRAWINGS

FIG. 1 is a schematic cross-sectional view of a surface-treated steel sheet according to the present embodiment.

EMBODIMENTS OF THE INVENTION

Hereinafter, a surface-treated steel sheet according to an embodiment of the present invention (a surface-treated steel sheet according to the present embodiment) will be described.

The surface-treated steel sheet 1 according to the present embodiment includes, as shown in FIG. 1, a steel sheet 11, a Zn-based plating layer 12 formed on the steel sheet 11, and a coating 13 formed on the Zn-based plating layer 12. In FIG. 1, the Zn-based plating layer 12 and the coating 13 are provided on only one surface of the steel sheet 11, but the Zn-based plating layer 12 and the coating 13 may be provided on both surfaces of the steel sheet 11.

In addition, the coating 13 contains Si, P, F, V, Zr, and optionally Al and/or Zn. A Si concentration, a P concentration, a F concentration, a V concentration, a Zr concentration, a Zn concentration, and an Al concentration of the coating 13 are, by mass %, Si: 10.00% to 25.00%, P: 0.01% to 5.00%, F: 0.01% to 2.00%, V: 0.01% to 4.00%, Zr: 0.01% to 3.00%, Zn: 0% to 3.00%. and Al: 0% to 3.00%, respectively.

In addition, in a narrow spectrum of Si2p obtained by performing X-ray photoelectron spectroscopy (XPS) analysis on a surface of the coating 13, a ratio of an integrated intensity of a peak having a local maximum value at 103.37±0.25 eV to an integrated intensity of a peak having a local maximum value at 102.26 35 0.25 eV is 0.04 or more and 0.25 or less.

Hereinafter, the steel sheet 11, the Zn-based plating layer 12, and the coating 13 will be described.

<Steel Sheet (Base Steel Sheet)>

In the surface-treated steel sheet 1 according to the present embodiment, excellent coating adhesion and corrosion resistance can be obtained by the Zn-based plating layer 12 and the coating 13. Therefore, the steel sheet (base steel sheet) 11 is not particularly limited. The steel sheet 11 may be determined depending on a product to be applied, a required strength, a sheet thickness, and the like. For example, a hot-rolled steel sheet described in JIS G 3131: 2018 or a cold-rolled steel sheet described in JIS G 3141: 2021 can be used.

<Zn-based Plating Layer (Galvanized Layer)>

The Zn-based plating layer 12 included in the surface-treated steel sheet 1 according to the present embodiment is a plating layer formed on the steel sheet 11 and containing zinc.

A chemical composition of the Zn-based plating layer 12 is not limited as long as the Zn-based plating layer 12 is a plating layer primarily containing zinc. For example, the Zn-based plating layer 12 may be a zinc plating containing only zinc (that is, a Zn content is 100%). However, when the Zn-based plating layer 12 contains, as the chemical composition, by mass %, Al: 4.0% or more and less than 25.0%, Mg: 0% or more and less than 12.5%, Sn: 0% to 20%, and Bi: 0% or more and less than 5.0%, In: 0% or more and less than 2.0% Ca: 0% to 3.0%, Y: 0% to 0.5%, La: 0% or more and less than 0.5%, Ce: 0% or more and less than 0.5%, Si: 0% or more and less than 2.5%, Cr: 0% or more and less than 0.25%. Ti: 0% or more and less than 0.25%, Ni: 0% or more and less than 0.25%, Co: 0% or more and less than 0.25% V: 0% or more and less than 0.25%, Nb: 0% or more and less than 0.25%, Cu: 0% or more and less than 0.25%, Mn: 0% or more and less than 0.25%, Fe: 0% to 5.0%, Sr: 0% or more and less than 0.5%, Sb: 0% or more and less than 0.5%, Pb: 0% or more and less than 0.5%, B: 0% or more and less than 0.5%, and a remainder Zn and impurities, there is a more significant effect of improving corrosion resistance, which is preferable.

The reason for the preferable chemical composition of the Zn-based plating layer 12 will be described. Hereinafter a numerical range indicated by "to" include therein basically includes numerical values at both ends thereof as a lower limit and an upper limit. In a case where a numerical value is stated with less than or more than, the numerical value is not included as a lower limit or an upper limit.

Unless otherwise specified, % regarding the chemical composition of the Zn-based plating layer 12 is mass %.

[Al: 4.0% or More and Less Than 25.0%]

Al is an effective element for improving corrosion resistance in the Zn-based plating layer 12. In a case where the above effect is sufficiently obtained, an Al content is set to 4.0% or more. In order to improve the corrosion resistance, a lower limit of the Al content may be set to 5.0%, 6.0%, 8.0%, 10,0% or 12.0%, as necessary On the other hand, when the Al content is 25.0% or more, corrosion resistance of a cut end surface of the Zn-based plating layer 12 decreases. Therefore, the Al content is less than 25.0%. As necessary, an upper limit of the Al content may be set to 24.0%, 22.0%, 20.0%, 18.0%, or 16.0%.

The Zn-based plating layer 12 may contain Al and the remainder including Zn and impurities. However, the following elements may be further contained as necessary. Since the following elements do not necessarily have to be included, lower limits thereof are 0%. In order to improve the corrosion resistance of the cut end surface, a Zn content is preferably 40% or more, and may be, as necessary, 50% or more, 60% or more, 70% or more, 80% or more, 90% or more, or 96% or more.

[Mg: 0% or More and Less Than 12.5%]

Inclusion of Mg is not essential, and a lower limit of a Mg content is 0%. Mg is an element having an effect of enhancing the corrosion resistance of the Zn-based plating layer 12. In a case where the above effect is sufficiently obtained, the Mg content is preferably set to 0.5% or more or more than 1.0. In order to improve the corrosion resistance, the lower limit of the Mg content may be set to 1.5%, 2.0%, 4.0%, 5.0%, or 6.0%, as necessary.

On the other hand, when the Mg content is 12.5% or more, the effect of improving the corrosion resistance is saturated, and there are cases where workability of the plating layer decreases. In this case, there arises a manufacturing problem, such as an increase in the amount of dross generated in a plating bath. Therefore, the Mg content is set to less than 12.5%. As necessary, an upper limit of the Mg content may be set to 12.0%, 11.0%, 10.0%, 9.0%, or 8.0%.

[Sn: 0% to 20%]

[Bi: 0% or More and Less Than 5.0%]

[In: 0% or More and Less Than 2.0%]

Inclusion of these elements is not essential, and lower limits of amounts of these elements are 0%. These elements are elements that contribute to the improvement in corrosion resistance and sacrificial protection. Therefore, any one or more thereof may be contained. In a case where the above effect is obtained, the amounts thereof are preferably set to 0.05% or more, 0.1% or more, or 0.2% or more.

Among the elements, Sn is a low melting point metal and can be easily contained without impairing properties of the plating bath, which is preferable.

On the other hand, when a Sn content is more than 20%, a Bi content is 5.0% or more, or an In content is 2.0% or more, the corrosion resistance decreases. Therefore, the Sn content is set to 20% or less, the Bi content is set to less than 5.0%, and the In content is set to less than 2.0%. As necessary, an upper limit of the Sn content may be set to 15.0%, 10.0%, 7.0%, 5.0%, or 3.0%, and an upper limit of the Bi content may be set to 4.0%, 3.0%, 2.0%, 1.0%, or 0.50%, and an upper limit of the In content may be set to 1.5%, 1.2%, 1.0%, 0.8%, or 0.5%.

[Ca: 0% to 3.0%]

Inclusion of Ca is not essential, and a lower limit of a Ca content is 0%. Ca is an element that reduces the amount of dross that is likely to be formed during an operation and contributes to an improvement in plating manufacturability. Therefore, Ca may be contained. In a case where this effect is obtained, the Ca content is preferably set to 0.1% or more. As necessary, the lower limit of the Ca content may be set to 0.2%, 0.3%, or 0.5%.

On the other hand, when the Ca content is high, corrosion resistance itself of a flat portion of the Zn-based plating layer 12 tends to deteriorate, and corrosion resistance around a welded part may also deteriorate. Therefore, the Ca content is preferably set to 3.0% or less. As necessary, an upper limit of the Ca content may be set to 2.5%, 2.0%, 1.5%, 1.0%, or 0.8%.

[Y: 0% to 0.5%]

[La: 0% or More and Less Than 0.5%]

[Ce: 0% or More and Less Than 0.5%]

Inclusion of these elements is not essential, and lower limits of amounts of these elements are 0%. Y. La, and Ce are elements that contribute to the improvement in corrosion resistance. In a case where this effect is obtained, it is preferable that one or more of the elements are contained in an amount of 0.05% or more or 0.1% or more.

On the other hand, when the amounts of these elements become excessive, a viscosity of the plating bath increases, and it is often difficult to prepare the plating bath itself, so that there is a concern that a steel having good plating properties cannot be manufactured. Therefore; it is preferable that a Y content is set to 0.5% or less, a La content is set to less than 0.5%, and a Ce content is set to less than 0.5%. As necessary, an upper limit of the Y content may be set to 0.4%, 0.3%, or 0.2%, and an upper limit of the La content may be set to 0.4%, 0.3%. or 0.2%, and an upper limit of the Ce content may be set to 0.4%, 0.3%, or 0.2%.

[Si: 0% or More and Less Than 2.5%]

Inclusion of Si is not essential, and a lower limit of a Si content is 0%. Si is an element that contributes to the improvement in corrosion resistance. In addition, Si is also an element that has an effect of suppressing formation of an excessively thick alloy layer between the surface of the steel sheet 11 and the Zn-based plating layer 12 in forming the Zn-based plating layer 12 on the steel sheet, thereby improving adhesion between the steel sheet 11 and the Zn-based plating layer 12. In a case where these effects are obtained, the Si content is preferably set to 0.1% or more. The Si content is more preferably 0.2% or more or 0.3% or more.

On the other hand, when the Si content is 2.5% or more, excessive Si is precipitated in the Zn-based plating layer 12, and not only the corrosion resistance but also the workability of the plating layer deteriorates. Therefore, the Si content is preferably set to less than 2.5%. The Si content is more preferably 2.0% or less, 1.5% or less, 1.0% or less, or 0.8% or less.

[Cr: 0% or More and Less Than 0.25%]

[Ti: 0% or More and Less Than 0.25%]

[Ni: 0% or More and Less Than 0.25%]

[Co: 0% or More and Less Than 0.25%]

[V: 0% or More and Less Than 0.25%]

[Nb: 0% or More and Less Than 0.25%]

[Cu: 0% or More and Less Than 0.25%]

[Mn: 0% or More and Less Than 0.25%]

Inclusion of these elements is not essential, and lower limits of amounts of these elements are 0%. These elements are elements that contribute to the improvement in corrosion resistance. In a case where this effect is obtained, amounts of one or more of these elements are preferably set to 0.05% or more or 0.10% or more.

On the other hand, when the amounts of these elements become excessive, the viscosity of the plating bath increases, and it is often difficult to prepare the plating bath itself, so that there is a concern that a steel having good plating properties cannot be manufactured. Therefore, the amount of each of the elements is preferably set to less than 0.25%. An upper limit of the amount of each of the elements may be set to 0.20% or 0.15%.

[Fe: 0% to 5.0%]

Inclusion of Fe is not essential, and a lower limit of an Fe content is 0%. There are cases where Fe may be mixed into the Zn-based plating layer 12 as an impurity when the Zn-based plating layer 12 is manufactured. Although Fe may be contained in an amount up to about 5.0%, an adverse effect on the effects of the surface-treated steel sheet 1 according to the present embodiment is small as long as Fe is contained in this range. Therefore, the Fe content is preferably set to 5.0% or less. As necessary, an upper limit of the Fe content may be set to 4.0%, 3.0%, 2.0%, or 1.0%.

[Sr: 0% or More and Less Than 0.5%]

[Sb: 0% or More and Less Than 0.5%]

[Pb: 0% or More and Less Than 0.5%]

Inclusion of these elements is not essential, and lower limits of amounts of these elements are 0%. When Sr, Sb, and Pb are contained in the Zn-based plating layer 12, an external appearance of the Zn-based plating layer 12 changes, spangles are formed, and an improvement in metallic gloss is confirmed. In a case where this effect is obtained, the amount of one or more of Sr, Sb, and Pb is preferably set to 0.05% or more or 0.08% or more.

On the other hand, when the amounts of these elements become excessive, the viscosity of the plating bath increases, and it is often difficult to prepare the plating bath itself, so that there is a concern that a steel having good plating properties cannot be manufactured. Therefore, the amount of each of the elements is preferably set to less than 0.5%. As necessary, an upper limit of the amount of each of the elements may be set to 0.4%, 0.3%, 0.2%, or 0.1%.

[B: 0% or More and Less Than 0.5%]

Inclusion of B is not essential, and a lower limit of a B content is 0%. B is an element that, when contained in the Zn-based plating layer 12, combines with Zn, Al, Mg, or the like to form various intermetallic compounds. The interrnetallic compounds have an effect of improving liquid metal embrittlement (LME). In a case where this effect is obtained, the B content is preferably set to 0.05% or more or 0.08 or more.

On the other hand, when the B content is excessive, a melting point of the plating rises significantly, plating operability deteriorates, and there is a concern that a surface-treated steel sheet having good plating properties cannot be obtained. Therefore, the B content is preferably set to less than 0.5%. As necessary, an upper limit of the B content may be set to 0.4%, 0.3%, 0.2%, or 0.1%.

Although an adhesion amount of the Zn-based plating layer 12 is not limited, the adhesion amount per surface is preferably 10 g/m$^2$ or more in order to improve the corrosion resistance. As necessary, the adhesion amount may be set to 20 g/m$^2$ or more, 30 g/m$^2$ or more, 40 g/m$^2$ or more, 50 g/m$^2$ or more, or 60 g/m$^2$ or more.

On the other hand, even if the adhesion amount is more than 200 g/m$^2$, the corrosion resistance is saturated, which is economically disadvantageous. Therefore, the adhesion amount is preferably 200 g/m$^2$ or less. As necessary, the adhesion amount may be set to 180 g/m$^2$ or less, 170 g/m$^2$ or less, 150 g/m$^2$ or less, 140 g/m$^2$ or less, or 120 g/m$^2$ or less.

<Coating>

[Si Concentration, P Concentration, F Concentration, V Concentration, Zr Concentration, Zn Concentration, and Al Concentration]

In the surface-treated steel sheet 1 according to the present embodiment, the coating 13 is formed on the Zn-based plating layer 12. The coating 13 contains Si (usually present as a silicon compound), which is a coating-forming component, and P, F, V, and Zr, which are inhibitor components, primarily in a compound state. In addition, there are cases where Zn and Al are further contained as the inhibitor components.

Since the silicon compound, which is the coating-forming component, is a primary component, the Si concentration of the coating 13 is 10.00% or more. By primarily using a silane coupling agent as a surface treatment metal agent (treatment liquid), which is a source of the coating 13, the Si concentration can be set to 10.00% or more. On the other hand, when the surface treatment metal agent contains a large amount of a resin (for example, a polyurethane resin, a polyester resin, an acrylic resin, an epoxy resin, a polyolefin resin, or a fluororesin) (for example, a resin having a solid content of 20 mass % or more is contained), the Si concentration becomes less than 10.00%. Therefore, it is preferable that a large amount of the resin is not contained in (not added to) the surface treatment metal agent.

More specifically, in the surface-treated steel sheet 1 according to the present embodiment, the Si concentration, the P concentration, the F concentration, the V concentration, the Zr concentration, the Zn concentration, and the Al concentration of the coating are, by mass %, Si: 10.00% to 25.00%, P: 0.01% to 5.00%, F: 0.01% to 2.00%, V: 0.01% to 4.00%, Zr: 0.01% to 3.00%, Zn: 0% to 3.00%, and Al: 0% to 3.00%, respectively.

When the Si concentration of the coating is less than 10.00%, film formation becomes insufficient. Therefore, the Si concentration is set to 10.00% or more. On the, other hand, when the Si concentration is more than 25.00%, there are cases where the coating is powdered and film formation is not achieved. Therefore, the Si concentration is set to 25.00% or less. In addition, when the P concentration, the F concentration, the V concentration, the Zr concentration, and the Zn concentration are outside of the above ranges, the corrosion resistance decreases due to a deficiency of the inhibitor or a decrease in a barrier property.

A lower limit of the Si concentration, is preferably 11.00%, 12.00% or 13.00%. An upper limit of the Si concentration is preferably 23.00%, 21.00%, 20.00% or 18.00%.

A lower limit of the P concentration is preferably 0.02%. 0.05%, 0.10%, 0.30%, 0.50% 0.80%, 1.00%, 1.30% or 1.60%. An upper limit of the P concentration is preferably 4.50%, 4.00%, 3.50%, 3.00%, or 2.50%.

A lower limit of the F concentration is preferably 0.02%, 0.05%, 0.08%, 0.10%, 0.10%, 0.50%. 0.70%, or 0.90%. An upper limit of the F concentration is preferably 1.90%, 1.80%, 1.70%, 1.60%, or 1.50%.

A lower limit of the V concentration is preferably 0.02% 0.05%, 0.08%, 0.10%, 0.20%, 0.30%, 0.50%, 0.80%, or 1.00%. An upper limit of the V concentration is preferably 3.80%, 3.50%, 3.00%, 2.50%, 2,00%, or 1.50%.

A lower limit of the Zr concentration is preferably 0.02%, 0.05%, 0.08%, 0.20% 0.30%, 0..50%, 0.80%, or 1.00%. An upper limit of the Zr concentration is preferably 2.90%, 2.70%, 2.50%, 2.20%, 2.00% or 1.50%.

A lower limit of the Zn concentration is preferably 0.01%, 0.05%, 0.08%, 0.20%, 0.30%, 0.50%, 0.80%, or 1.00%. An upper limit of the Zn concentration is preferably 2.90%, 2.70%, 2.50% 220%, 2.00%, or 1.50%.

A lower limit of the Al concentration is preferably 0.01%, 0.05%, 0.08%, 0.10%, 0.20%, 0.30%, 0.50%, 0.80%, or 1.00%. An upper limit of the Al concentration is preferably 2.80% or less, 2.70%, 2.50%, 2.20%, 2.00%, or 1.50%.

The coating 13 may be, for example, a chemical conversion coating or a coating film.

The Si concentration, the P concentration, the concentration, the V concentration, and the Zr concentration of the coating 13 are measured by the following method.

A sample having a size that can be inserted into a cryo-focused ion beam (FIB) processing apparatus is cut out from the surface-treated steel sheet in which the coating is formed, and a test piece having a thickness of 80 to 200 nm is cut out from the sample by a cryo-FIB method, and a cross-sectional structure of the cut-out test piece is observed with a transmission electron microscope (TEM) at a magnification at which the entire chemical conversion layer is included in an observed visual field. In order to specify constituent elements of each layer, TEM-energy dispersive X-ray spectroscopy (EDS) is used, and quantitative, analysis of Si, P, F, V, and Zr is performed on a film thickness central part of the coating 13 in the coating 13 at five or more points at an interval of 100 μm in a direction parallel to the surface of the surface-treated steel sheet. Average values of measurement results of the points are adopted as the Si concentration, the P concentration, the F concentration, the V concentration, and the Zr concentration. That is, these concentrations are the concentrations of the central part of the coating 13.

On the other hand, for the Zn concentration and the Al concentration, the Zn concentration and the Al concentration are measured on the surface of the coating 13 by X-ray photoelectron spectroscopy (XPS) analysis under the same conditions as measurement,of the narrow spectrum of Si2p, which will be described later. That is, the Zn concentration and the Al concentration are concentrations on the surface of the coating 13. As is well known, XPS analysis enables quantitative analysis of elements present on the surface of the sample as well as a ratio between integrated intensities of peaks of a specific spectrum, which will be described later.

[In Narrow Spectrum of Si2p Obtained by Performing XPS Analysis on Surface, Ratio of Integrated Intensity of Peak Having Local Maximum Value at 103.37±0.25 eV to Integrated Intensity of Peak Having Local Maximum Value at 102.26±0.25 eV Is 0.04 or More and 0.25 or Less]

In the related art, a coating containing a silicon compound and other inhibitor components (chemical conversion coating) is known, and the chemical conversion coating in the related art can be obtained by applying a treatment liquid containing a silane coupling agent and an inhibitor component onto a plating layer, and drying the resultant under predetermined conditions. Therefore, in the coating in the related art, the silicon compound is an organic silicon compound having a cyclic siloxane bond. Although this organic silicon compound has excellent adhesion to various paints, the organic silicon compound also has good compatibility with water. Therefore, there are cases where moisture adhering to the surface of the coating easily permeates into the coating and finally to a surface of plating, resulting in deterioration in corrosion resistance.

As a result of studies by the present inventors, it was found that by changing an organic silicon compound on a portion of the surface of the coating 13, which has the organic silicon compound having a cyclic siloxane bond as a matrix to a state having a high barrier property, permeation of moisture can be suppressed, and as a result, the corrosion resistance of the surface-treated steel sheet 1 is improved.

In addition, it was found that whether or not the surface of the coating 13 has changed to a state having a high barrier property can be evaluated by an integrated intensity ratio between two types of peaks obtained by performing XPS analysis.

Specifically, in the narrow spectrum of Si2p obtained by performing XPS analysis on the surface of the coating 13 (which is also the surface of the surface-treated steel sheet 1), when the ratio of the integrated intensity of the peak having a local maximum value at 103.37±0.25 eV to the integrated intensity of the peak having a local maximum value at 102.26±0.25 eV is 0.04 or more and 0.25 or less, corrosion resistance can be improved without lowering the coating adhesion in the coating 13 having the organic silicon compound having the cyclic siloxane bond as the matrix.

Here, in the narrow spectrum of Si2p obtained by performing XPS analysis, the peak having a local maximum value at 102.26±0.25 eV is derived from a Si—OH or Si—O—Si bond and is thus considered to be a peak, of the organic silicon compound having the cyclic siloxane bond. In addition, the peak having a local maximum value at 103.37±0.25 eV is considered to be a peak of a silicon oxide compound. That is, in the narrow spectrum of Si2p obtained by performing XPS analysis, an increase in the ratio of the integrated intensity of the peak having a local maximum value at 103 37±0.25 eV to the integrated intensity of the peak having a local maximum value at 102.26±0.25 eV indicates an increase in a proportion of the organic silicon compound changed to the silicon oxide compound on the surface. It is presumed that since the silicon oxide compound has a lower moisture permeability than the organic silicon compound, the corrosion resistance is improved by changing the organic silicon compound to the silicon oxide compound.

In the narrow spectrum of Si2p obtained by performing XPS analysis, when the ratio of the integrated intensity of the peak having a local maximum value at 103.37±0.25 eV to the integrated intensity of the peak having a local maximum value at 102.26±0.25 eV is less than 0.04, the above effect cannot be sufficiently obtained. On the other hand, when the ratio of the integrated intensity is more than 0.25, the proportion of the organic silicon compound becomes too low, and the coating adhesion decreases. Here, "±0.25 (eV)" is a margin of measurement.

The integrated intensity ratio is obtained by performing analysis in the following manner using XPS.

That is, using a Quantum2000 type XPS analyzer manufactured by LTI.VAC-PHI, Inc. or an apparatus equivalent thereto, a region of 800 μm×300 μm of the surface of the surface-treated steel sheet 1 (surface of the coating 13) that has not been subjected to a pretreatment such as cleaning or sputtering is analyzed, for example, under the following conditions. The obtained Si2p spectrum is separated into a peak having a local maximum value at 102.26±0.25 eV and a peak having a local maximum value at 103.37±0.25 eV, integrated intensities of the peaks are obtained, and an integrated intensity ratio is calculated based on the integrated intensities.

However, in the narrow spectrum obtained by the analysis, there are cases where peak positions are shifted to the left or right depending on a measuring instrument and conditions. Therefore, first, position correction of the obtained spectrum is performed so that a peak position (a position having a local maximum value) of a C1s spectrum becomes 284.8 eV, and thereafter the Si2p spectrum is separated into the peak having a local maximum value at 102.26±0.25 eV and the peak having a local maximum value at 103.37±0.25 eV.

At the time of measurement, a region of 96 to 108 eV in the Si2p spectrum is measured. Particularly, a regiort in which peak separation is performed is basically set to 99 to 106 eV, and is extended therefrom according to the spectrum. In addition, the measurement is performed on the assumption that a half-width of the peak having a local maximum value at 102.26±0.25 eV is 1.46±0.2 eV and a half-width of the peak having a local maximum value at 103.37±0.25 eV is 1.42±0.2 eV. Since no pretreatnrient is performed during the analysis, the sample has to be handled with care to avoid adhesion of oil, dirt, and the like as much as possible. Details of other measurement conditions (analysis conditions) are described below.

(Measurement Conditions)

X-ray source: monoAlKα (1486.6 eV)

X-ray output: 15 kV 25W

X-ray diameter: 100 μmφ

Degree of vacuum of analytical chamber (before sample introduction): $2.2\times10^{-9}$ torr Detection angle: 45°

Neutralization: electron neutralization, ion neutralization

Data analysis software: MultiPak V 8.0 (manufactured by ULVAC-PHI,

For the XPS analysis, it is preferable to collect a sample from a width 1/4 position of the steel from an end portion of the surface-treated steel sheet in a width direction thereof.

[Preferably, on Surface, Zn Concentration Is 0.10% to 3.00% by mass %]

As described above, in a case /here the surface of the surface-treated steel sheet 1 (the surface of the coating 13) is coated, there are cases where alkaline degreasing is performed before coating. However, in the case of a surface-treated steel sheet having a coating (chemical conversion coating) in the related art, when alkaline degreasing is performed, there are cases where the coating is dissolved and wears. Even if coating is performed on such a portion, sufficient coating adhesion cannot be obtained.

As a result of studies by the present inventors, it was found that the resistance to an alkaline degreasing liquid is improved by increasing the Zn concentration on the surface of the coating 13. Specifically, it was found that when the Zn concentration on the surface of the coating 13 is 0.10 mass % or more and 3.00 mass % or less, the coating adhesion after alkaline degreasing is excellent. The reason for this is not clear, but it is presumed that inclusion of a certain amount of Zn, which is stable in a high pH region, in the surface of the coating 13 strengthens the coating 13.

Therefore, in the surface-treated steel sheet 1 according to the present embodiment, the Zn concentration on the surface of the coating 13 is preferably set to 0.10% or more by mass %. When the Zn concentration is less than 0.10%, a sufficient effect cannot be obtained. As necessary, the Zn concentration may be set to 0.20% or more, 0.30% or more, 0.40% or more, or 0.60% or more.

On the other hand, when the Zn concentration on the surface of the coating 13 is more than 3.00% by mass %, the surface of the coating 13 becomes hard and the coating adhesion decreases. In addition, powdering resistance also decreases. Therefore, the Zn concentration on the, surface of the coating 13 is 3.00% or less. As necessary, the Zn concentration may be set to 2.80% or less, 2.50% or less, 2.20% or less, or 1.90% or less.

[Preferably, on Surface, Al Concentration Is 0.10% to 3.00% by mass %]

As described above, the corrosion resistance (white rust resistance) is improved by changing a portion of the organic silicon compound on the surface of the coating 13 to the silicon oxide compound. However, in a case where the surface-treated steel sheet having such a coating 13 is used in an outdoor exposure environment, there are cases where a C—C bond and a C—H bond contained in the organic silicon compound are broken by ultraviolet rays, and the corrosion resistance does not reach a target level.

As a result of studies by the present inventors, it was found that by setting the Al concentration on the surface of the coating 13 to 0.10% or more by mass %, excellent corrosion resistance can be obtained even in an outdoor exposure environment. The reason for this is not clear, but it is presumed that in a case where Al is contained in the surface of the coating 13, Al enhances a binding force of the organic silicon compound having the cyclic siloxane bond, and Al easily reflects ultraviolet rays, so that fracture of the coating 13 due to the ultraviolet rays is suppressed. Therefore, the Al concentration on the surface of the coating 13 is preferably set to 0.10% or more. As necessary, the Al concentration may be set to 0.20% or more, 0.30% or more, 0.40% or more, or 0.60% or more.

On the other hand, when the Al concentration on the surface of the coating 13 is more than 3.00%, the effect of improving the corrosion resistance is saturated, a high cost is incurred, and the surface of the coating 13 is whitened and deteriorates the external appearance. Therefore, on the surface of the coating 13, the Al concentration is 3.00% or less. As necessary, the Al concentration may be set to 2.80% or less, 2.50% or less, 2.20% or less, or 1.90% or less.

In a case where Al and Zn are contained in the surface of the coating 13, the total concentration is preferably 3.00%. As necessary, the total concentration may be set to 2.80% or less, 2.60% or less, 2.40% or less, or 2.00% or less.

The Zn concentration and the Al concentration on the surface of the coating 13 can be measured by performing XPS analysis under the same conditions as those for measuring the narrow spectrum of Si2p described above.

Here, the concentrations are measured on the surface of the coating 13 at five points at an interval of 100 μm in a certain direction starting from a certain point, and an average value of the measured values is adopted.

In the surface-treated steel sheet according to the present embodiment, in addition to the control of the surface as described above, as will be described later, by distributing optimum components for components constituting the matrix of the coating 13 in a cross-sectional direction (thickness direction), corrosion resistance under stricter conditions is improved, which is preferable.

[Coating Has P-Enriched Layer Having P Concentration Higher than Average P Concentration in Range from Surface of Coating to Interface between Coating And Zn-based plating layer in Thickness Direction of Steel Sheet]

[P-Enriched Layer Is Present Adjacent to Interface with Plating Layer]

[When Line Analysis of TEM-EDS Is Performed to Obtain P Concentration from Surface of Coating to Interface between Coating and Plating Layer, Ratio of Maximum Value of P Concentration to Average P Concentration Is 1.20 to 2.00]

As a result, of studies by the present inventors, it was found that by causing a region (enriched layer) having a P concentration higher than an average P concentration (that is, an average P concentration in the entire coating 13) to be present on an interface side of the coating 13 with the Zn-based plating layer 12 (a position adjacent to an interface with the Zn-loased plating layer 12) in a range from the surface of the coating 13 to the interface between the coating 13 and the Zn-based plating layer 12 in a thickness direction of the steel sheet, and when line analysis is performed to obtain the P concentration from the surface of the coating 13 to the interface between the coating 13 and the Zn-based plating layer 12 using EDS, by causing a ratio of a maximum value of the P concentration in the enriched layer to the average P concentration to be 1.20 to 2.00, the corrosion resistance is further improved.

The reason why the corrosion resistance is improved in the presence of the above-described enriched layer is considered as follows.

In a case where a treatment liquid containing a fluorine compound and a P compound as an inhibitor component is applied to a plating layer containing zinc under predetermined conditions and dried, pH fluctuation caused by an etching reaction with the fluorine compound is neutralized, and the P compound moves toward the Zn-based plating layer 12 side. The P compound that has moved to the Zn-based plating layer 12 side forms a composite salt with Zn eluted from the Zn-based plating layer 12 into the coating 13 in the vicinity of the interface between the coating 13 and the plating layer 12 in the coating 13, so that a coating that is impervious to air and water is formed. As a result, it is considered that the corrosion resistance is improved.

Having the above-described enriched layer indicates that the composite salt of P and Zn is formed in the vicinity of the interface with the Zn-based plating layer 12 in the coating 13, so that it is considered that the corrosion resistance is improved in the presence of the enriched layer.

In a case where the enriched layer is not present or the P concentration is high at a position other than the vicinity of the interface with the Zn-based plating layer 12, the composite salt of P and Zn is not sufficiently formed, permeation of air and water into the coating 13 is insufficiently suppressed, and the corrosion resistance is not sufficiently improved.

From the viewpoint of the effect of improving the corrosion resistance, the ratio of the maximum value of the P concentration to the average P concentration (maximum value of concentration/average concentration) is preferably 1.20 or more. The ratio is more preferably 1.30 or more and even more preferably 1.50 or more.

On the other hand, when the (maximum value of concentration/average concentration) is more than 2.00, the adhesion between the Zn-based plating layer 12 and the coating 13 decreases, and corrosion resistance of a processed portion decreases, which is not preferable. The cause of this is not clear, but it is presumed that a composite salt of P and Zn is excessively generated between the Zn-based plating layer 12 and the coating 13. Therefore, the ratio of the maximum value of the P concentration to the average P concentration is preferably 2.00 or less. The ratio is more preferably 1.80 or less or 1.60 or less.

A thickness of the P-enriched layer is preferably 5 nm or more in order to obtain a sufficient effect. On the other hand, the thickness of the enriched layer is preferably 100 nm or less from the viewpoint of coating followability during processing.

Coating Has F-Enriched Layer Having F Concentration Higher than Average F [Concentration in Range from Surface of Coating to Interface between Coating And Zn-based plating layer in Thickness Direction of Steel Sheet]

[F-Enriched Layer is Present Adjacent to Interface with Zn-Based Plating Layer]

[When Line Analysis of TEM-EDS Is Performed to Obtain F Concentration from Surface of Coating to Interface between Coating and Plating Layer, Ratio of Maximum Value of F Concentration to Average F Concentration Is 1.50 to 2.30]

In addition, as a result of studies by the present inventors, it was found that by causing a region (enriched layer) having a F concentration higher than an average F concentration (that is, an average F concentration in the entire coating) to be present on the interface side of the coating 13 with the Zn-based plating layer 12 (a position adjacent to the interface with the Zn-based plating layer 12) in the range from the surface of the coating 13 to the interface between the coating 13 and the Zn-based plating layer 12 in the thickness direction of the steel sheet, and when line analysis is performed to obtain the F concentration from the surface of the coating to the interface between the coating 13 and the Zn-based plating layer 12 using EDS, by causing a ratio of a maximum value of the F concentration in the enriched layer to the average F concentration in the range from the surface of the coating 13 to the interface between the coating 13 and the Zn-based plating layer 12 to be 1.50 or more, the corrosion resistance (particularly the corrosion resistance of the processed portion) is further improved.

Enrichment of F is controlled by an etching component in the treatment liquid, a temperature of the treatment liquid, drying conditions, and the like. When the treatment is performed under predetermined conditions, the etching component of the treatment liquid reacts with the surface of plating, F moves to the surface of plating, and F is enriched on the surface of plating.

When the F-enriched layer is present ata position adjacent to the interface of the coating with the Zn-based plating layer 12, F and Zn form a composite salt, and the coating 13 is less permeable to corrosion factors such as water. As a result, it is considered that the corrosion resistance is improved.

When the ratio of the maximum value of the F concentration to the average F concentration in the range from the surface of the coating 13 to the interface between the coating 13 and the Zn-based plating layer 12 is 1.50 or more, the effect of improving the corrosion resistance is sufficiently obtained, which is preferable. The ratio is more preferably 1.70 or more.

On the other hand, when the ratio of the maximum value of the F concentration to the average F concentration is more than 2.30, the adhesion between the Zn-based plating layer 12 and the coating 13 decreases, and the corrosion resistance of the processed portion decreases, which is not preferable. The cause of this is not clear, but it is presumed that a composite salt of F and Zn is excessively generated between the Zn-based plating layer 12 and the coating 13. Therefore, the ratio of the maximum value of the F concentration to the average F concentration in the range from the surface of the coating 13 to the interface between the coating 13 and the Zn-based plating layer 12 is preferably 2.30 or less. The ratio is more preferably 2.10 or less or 1.90 or less.

In the surface-treated steel sheet according to the present embodiment, in the coating 13, the positions and thicknesses of the P-enriched layer and the F-enriched layer, the average values of the P concentrations and the F concentrations, the maximum value of the P concentration in the P-enriched layer, and the maximum value of the F concentration in the F-enriched layer are obtained by line analysis of TEM-EDS.

Specifically, a sample having a size that can be inserted into a cryo-FIB processing apparatus is cut out from the surface-treated steel sheet 1 in which the coating 13 is formed, and a test piece having a thickness of 80 to 200 nm is cut out from the sample by a cryo-FIB method, and a cross-sectional structure of the cut-out test piece is observed with a transmission electron microscope (TEM) at a magnification at which the entire coating is included in an observed visual field. In order to specify constituent elements of each layer, TEM-energy dispersive X-ray spectroscopy (EDS) is used, and quantitative analysis of a chemical composition at each location is performed by performing line analysis along the thickness direction. A line analysis method is not particularly limited, but continuous point analysis at intervals of several nm may be used, or an elemental map in any region may be measured and a thickness distribution of elements may be measured on average in a surface direction. The elements to be subjected to quantitative analysis are six elements, C, O, F, Si, P, and Zn, and a denominator for calculating the concentration of each element is the sum of the concentrations of the six elements. The apparatus to be used is not particularly limited, and for example, a TEM (field emission type transmission electron microscope manufactured by JEOL Ltd.: JEM-2100F) or an EDS (JED-2300T manufactured by JEOL Ltd.) may be used.

From the above-described TEM-EDS line analysis results, concentration distributions of P and F are obtained, the enriched layers are specified, and the thicknesses of the enriched layers are measured. In addition, the maximum values of the P concentration and the F concentration in the enriched layers are obtained.

When the thickness of the enriched layer specified by the TEM is about 5 nm. it is preferable to use a TEM having a spherical aberration correction function from the viewpoint of spatial resolution.

In the surface-treated steel sheet according to the present embodiment, a point at which the P concentration is maximized is present in the vicinity of the interface between the coating 13 and the Zn-based plating layer 12, and the region (enriched layer) having a P concentration higher than the average P concentration of the Zn-based plating layer 12 is present in a certain thickness range from the interface with the Zn-based plating layer 12. Similarly, the F concentration also increases in the vicinity of the interface with the Zn-based plating layer 12.

<Manufacturing Method>

Next, a preferred manufacturing method of the surface-treated steel sheet 1 according to the present embodiment will be described.

The surface-treated steel sheet 1 according to the present embodiment can obtain the effects as long as the above-described properties are provided regardless of the manufacturing method. However, the steel sheet according to the present embodiment and the surface-treated steel sheet 1 according to the present embodiment can be stably manufactured by a manufacturing method described below, which is preferable.

That is, the surface-treated steel sheet 1 according to the present embodiment can be manufactured by a manufacturing method including the following steps:

(I) a plating step of immersing a steel sheet in a plating bath containing Zn to form a Zn-based plating layer on a surface;

(II) an applying step of applying a surface treatment metal agent (treatment liquid) to a steel having the Zn-based plating layer;

(III) a heating step of heating the steel sheet to which the surface treatment metal agent is applied to form a coating; and (IV) a cooling step of cooling the steel sheet after the heating step.

Hereinafter, preferable conditions for each step will be described.

[Plating Step]

The plating step is not particularly limited. A normal hot-dip galvanizing method may be used so that sufficient plating adhesion can be obtained.

In addition, a manufacturing method of the steel to be subjected to the plating step is also not limited.

For example, a method for manufacturing a zinc-plated steel sheet specified in JIS G 3302:2019 may be used, or a method for manufacturing a plated steel sheet specified in JIS G 3323:2019 may be used.

A composition of the plating bath may be adjusted depending on a composition of a desired Zn-based (zinc-based) plating layer.

[Applying Step]

In the applying step, the surface treatment metal agent (treatment liquid) is applied to the steel sheet (steel sheet provided with the Zn-based plating layer 12) after the plating step using a roll coater or the like.

As the surface treatment metal agent (treatment liquid), a treatment liquid containing a silicon compound, a phosphorus compound (P compound), a fluorine compound (F compound), a vanadium compound (V compound), a zirconium compound (Zr compound), and a zinc compound (Zn compound), and a carboxylic acid is used. Particularly, the silicon compound becomes the matrix of the coating 13, and the phosphorus compound, the fluorine compound, the vanadium compound, and the zirconium compound become the inhibitor components.

On the other hand, the zinc compound and the carboxylic acid are not essential as a coating-forming component. However, by including the zinc compound (X) and the carboxylic acid (Y) in the surface treatment metal agent, the organic silicon compound on a portion of the surface of the coating 13, which has the organic silicon compound having the cyclic siloxane bond as the matrix, is changed to a state having a high barrier property. A mechanism by which these components change the organic silicon compound on a portion of the surface of the coating 13, which has the organic silicon compound having the cyclic siloxane bond as the matrix, to a state having a high barrier property is not clear, but it is presumed that these components act as a catalyst for state change.

Regarding the chemical composition of the coating 13 of the surface-treated steel sheet according to the present embodiment, the following mixing ratio is preferable.

The carboxylic acid (Y) contained in the surface treatment metal agent is not particularly limited, but formic acid, acetic acid, propionic acid, and the like can be used.

Regarding the amount of the carboxylic acid (Y) to be mixed in the surface treatment metal agent, a molar ratio [(Ymol)/(Smol)] of the carboxylic acid (Y) to Si derived from the organic silicon compound (S) is set to 0.10 to 10.0. When [(Ymol)/(Smol)] is less than 0.10, it becomes difficult to change the organic silicon compound on a portion of the surface of the coating 13, which has the organic silicon compound having the cyclic siloxane bond as the matrix, to a state having a high barrier property. On the other hand, when [(Ymol)/(Smol)] is more than 10.00, bath stability decreases.

The zine compound contained in the surface treatment metal agent is not particularly limited, and zinc chloride, zinc nitrate, zinc sulfate, zinc fluoride, and the like can be used.

Regarding the amount of the zinc compound (X) to be mixed in the surface treatment metal agent, a solid content mass ratio [(Xs)/(Ss)] of Zn derived from the zinc compound (X) to Si derived from the organic silicon compound (S) is set to 0.01 to 0.50. When [(Xs)/(Ss)] is less than 0.01, it becomes difficult to change the organic silicon compound on a portion of the surface of the coating 13, which has the organic silicon compound having the cyclic siloxane bond as the matrix, to a state having a high barrier property. On the other hand, when [(Xs)/(Ss)] is more than 0.50, the bath stability decreases.

In addition, the zinc compound (X) contained in the surface treatment metal agent has an effect of improving alkali resistance on the surface of the coating 13 after the coating 13 is formed. In a case where such an effect is obtained, a solid content mass ratio [(Xs)/(NVs)] of Zn derived from the zinc compound (X) to the total solid content (NV) of the surface treatment metal agent is preferably 0.0010 or more. On the other hand, when [(Xs)/(NVs)] is more than 0.030, the powdering resistance decreases. Therefore, [(Xs)/(NVs)] is preferably 0.030 or less.

The organic silicon compound contained in the surface treatment metal agent is an organic silicon compound having a cyclic siloxane bond. The type of the organic silicon compound having the cyclic siloxane bond is not particularly limited, and the organic silicon compound having the cyclic siloxane bond is obtained by mixing a silane coupling agent (A) containing one amino group in a molecule with a silane coupling agent (B) containing one glycidyl group in a molecule. A mixing ratio of the silane coupling agent (A) to the silane coupling agent (B) is preferably 0.5 to 1.7 in terms of solid content mass ratio [(A)/(B)]. When the solid content mass ratio [(A)/(B)] is less than 0.5, there are cases where the bath stability and black residue resistance significantly decrease. On the other hand, when the solid content mass ratio [(A)/(B)] is more than 1.7, there are cases where water resistance significantly decreases, which is not preferable.

In addition, the phosphorus compound (T) contained in the surface treatment metal agent is not particularly limited, and examples thereof include phosphoric acid, ammonium phosphate, potassium phosphate, and sodium phosphate.

Regarding the amount of the phosphorus compound (T) to be mixed, a solid content mass ratio [(Ts)/(Ss)] of P derived from the phosphorus compound (T) to Si derived from the organic silicon compound (S) is preferably set to 0.15 to 0.31. When the solid content mass ratio [(Ts)/(Ss)] between P derived from the phosphorus compound (T) to Si derived from the organic silicon compound (S) is less than 0.15, there is a concern that an effect of the phosphorus compound (T) as an eluting inhibitor cannot be obtained. On the other hand, when [(Ts)/(Ss)] is more than 0.31, water solubility of the coating becomes significant, which is not preferable.

The fluorine compound (U) contained in the surface treatment metal agent of the present invention is not particularly limited, and examples thereof include ammonium titanium fluoride, hydroacid titanium fluoride, ammonium zirconium fluoride, hydroacid zirconium fluoride, hydrogen fluoride, and ammonium fluoride.

Regarding the amount of the fluorine compound (U) to be mixed, a solid content mass ratio [(Us)/(Ss)] of F derived from the fluorine compound (U) to Si derived from the organic silicon compound (S) is preferably set to 0.01 to 0.30. When the solid content mass ratio [(Us)/(Ss)] of F derived from the fluorine compound (U) to Si derived from the organic silicon compound (S) is less than 0.01, there are cases where the effect of improving the corrosion resistance becomes insufficient. On the other hand, when [(Us)/(Ss)] is more than 0.30, the water solubility of the coating 13 becomes significant, which is not preferable.

The Zr compound (V) contained in the surface treatment metal agent is not particularly limited, and examples thereof include ammonium zirconium carbonate, hydroacid zirconium hexafluoride, and ammonium zirconium hexafluoride.

Regarding the amount of the Zr compound (V) to be mixed, a solid content mass ratio [(Vs)/(Ss)] of Zr derived from the Zr compound (V) to Si derived from the organic silicon compound (S) is preferably set to 0.06 to 0.15. When the solid content mass ratio [(Vs)/(Ss)] between Zr derived from the Zr compound (V) to Si derived from the organic silicon compound (S) is less than 0.06, there are cases where the effect of improving the corrosion resistance becomes insufficient. On the other hand, when [(Vs)/(Ss)] is more than 0.15, the effect of improving the corrosion resistance is saturated.

The V compound (W) contained in the surface treatment metal agent of the present invention is not particularly limited, and examples thereof include vanadium pentoxide $V_2O_5$, metavanadic acid $HVO_3$, ammonium metavanadate, sodium metavanadate, vanadium oxytrichloride $VOCl_3$, vanadium trioxide $V_2O_3$, vanadium dioxide $VO_2$, vanadyl sulfate $VOSO_4$, vanadyl acetylacetonate $VO(OC(=CH_2)CH_2COCH_3))_2$, vanadium(III) acetylacetonate $V(OC(=CH_2)CH_2COCH_3))_3$, vanadium trichloride $VCl_3$, and phosphovanadomolybdic acid. In addition, those obtained by reducing a pentavalent vanadium compound to a tetravalent to divalent vanadium compound by an organic compound having at least one functional group selected from the group consisting of a hydroxyl group, a carbonyl group, a carboxyl group, a primary to tertiary amino group, an amide group, a phosphate group, and a phosphonic acid group.

Regarding the amount of the V compound (W) to be mixed, a solid content mass ratio [(Ws)/(Ss)] of V derived from the V compound (W) to Si derived from the organic silicon compound (S) is preferably set to 0.05 to 0.17. When the solid content mass ratio [(Ws)/(Ss)] of V derived from the V compound (W) to Si derived from the organic silicon compound (S) is less than 0.05, there are cases where the effect of improving the corrosion resistance becomes insufficient. On the other hand, when [(Ws)/(Ss)] is more than 0.17, the bath stability decreases, which is not preferable.

In a case where the Al concentration on the surface of the formed coating 13 is increased, it is preferable that the surface treatment metal agent used for manufacturing the surface-treated steel sheet 1 according to the present embodiment contains an Al compound (Z). The Al compound (Z) contained in the surface treatment metal agent is not particularly limited, and examples thereof include aluminum hydroxide, aluminum oxide, aluminum chloride, and aluminum sulfate.

Regarding the amount of the Al compound (Z) to be mixed, in a case where the Al concentration on the surface of the coating 13 is set to 0.10 to 3.00 mass%, a mass ratio [(Zs)/(NVs)] of Al derived from the Al compound (Z) to the total solid content (NV) of the surface treatment metal agent is preferably 0.001 to 0.030. When the mass ratio [(Zs)/(NVs)] of Al derived from the Al compound (Z) to the total solid content (NV) of the surface treatment metal agent is less than 0.001, there are cases where the Al concentration on the surface of the coating 13 does not increase, and the effect of improving the corrosion resistance in an outdoor exposure environment becomes insufficient. On the other hand, when [(Zs)/(NVs)] is more than 0.030, there is a concern that the external appearance of the coating deteriorates.

The temperature of the treatment liquid is not limited, and is preferably 30° C. or higher in a case where the reaction between the etching component of the treatment liquid and the surface of plating is promoted and the formation of the F-enriched layer is promoted. On the other hand, when the temperature of the treatment liquid is higher than 40° C., the temperature of the steel sheet easily exceeds 40° C., so that it becomes difficult to satisfy a requirement that a time until the temperature of the steel sheet after the treatment liquid is applied reaches 40° C. is 0.5 to 15.0 seconds (s), which is another requirement for forming the F-enriched layer. Therefore, the temperature of the treatment liquid is preferably 40° C.or lower.

[Heating Step]

In the heating step, the steel sheet to which the surface treatment metal agent is applied is heated and dried using a drying furnace or the like, thereby forming the coating 13 on the surface of the steel sheet. By heating the steel sheet to which the surface treatment metal agent is applied, the treatment liquid applied to the steel sheet is dried, and finally the coating 13 is formed. Here, it is necessary to impart a predetermined temperature history to the steel sheet to which the treatment liquid is applied (before the drying).

The heating step is divided into two treatments, a preliminary treatment and a main treatment, in which a step from 30° C. to immediately before the steel sheet to which the surface treatment metal agent is applied reaches 55° C. (here, in a case where the temperature of the steel sheet at the time of the application is 30° C. or higher, a step immediately before the temperature of the steel sheet reaches 55° C. immediately after the application) is referred to as the preliminary treatment, and a step after the steel sheet reaches 55° C. is referred to as the main treatment. The heating step will be described below.

In the heating step, in order to change the organic silicon compound on a portion of the surface of the coating, which has the organic silicon compound having the cyclic siloxane bond as the matrix, to a state having a high barrier property, the steel after the surface treatment metal agent is applied needs to be further held at a predetermined temperature for a predetermined time.

Specifically, in order to change the organic silicon compound on a portion of the surface of the coating 13, which has the organic silicon compound having the cyclic siloxane bond as the matrix, to a state having a high barrier property, in the preliminary treatment, the steel sheet to which the surface treatment metal agent is applied is held in a temperature range of 30° C. or higher and lower than 50° C.for 4.0 seconds or longer (that is, held for 4.0 seconds in a state where the temperature of the steel sheet is 30° C. or higher and lower than 50° C.).

In the main treatment after the preliminary treatment, by setting a maximum attainment temperature to 55° C. to 180° C, the steel sheet needs to be held in a temperature range of 55° C. to 180° C for 5 to 15 seconds.

When a time (staying time) for holding the steel sheet in a temperature range of 30° C. or higher and lower than 50° C. is shorter than 4.0 seconds, a time for changing the organic silicon compound on a portion of the surface of the coating, which has the organic silicon compound having the cyclic siloxane bond as the matrix, to a state having a high barrier property is insufficient, and the surface of the coating 13 cannot be changed to a state having a high barrier property. As a result, in the narrow spectrum of $Si_2p$ obtained by performing XPS analysis, the ratio of the integrated intensity of the peak having a local maximum value at 103.37 +0.25 eV to the integrated intensity of the peak having a local maximum value at 102.26 +0.25 eV becomes less than 0.04.

In addition, in a case where the holding time (staying time) of the steel sheet at 55° C. to 180° C. is shorter than 5 seconds, the amount of the organic silicon compound on the surface of the coating 13, which has the organic silicon compound having the cyclic siloxane bond as the matrix, changed to a state having a high barrier property is insufficient, and the effect of improving the corrosion resistance cannot be obtained. As a result, the ratio between the integrated intensities becomes less than 0.04.

On the other hand, in a case where the maximum attainment temperature of the steel sheet is higher than 180° C. or the holding time at 55° C. to 180° C. is longer than 15 seconds, an excessive amount of the organic silicon compound on the surface of the coating 13, which has the organic silicon compound having the cyclic siloxane bond as the matrix, is changed to a state having a high barrier property, and the ratio between the integrated intensities becomes more than 0.25. As a result, the coating adhesion decreases. Therefore, the maximum attainment temperature of the steel sheet is set to 55° C. to 180° C., and the staying time at 55° C. to 180° C. is set to 15 seconds or shorter.

Furthermore, in a case where the P-enriched layer is obtained, it is preferable that the steel sheet after the treatment liquid is applied is held in a temperature range of 40° C. or higher and lower than 50° C. for 0.5 to 25.0 seconds.

In addition, in a case where the F-enriched layer is obtained, it is preferable that the time from the application of the treatment liquid having a temperature of 30° C. or higher until the temperature of the steel sheet reaches 40° C. is set to 0.5 to 15.0 seconds.

[Cooling Step]

The steel sheet after the main treatment (after the heating step) is cooled to lower than 50° C. A cooling method is not particularly specified, and air cooling, water cooling, or the like can be used.

EXAMPLE

Cold-rolled steel sheets having a sheet thickness of 0.8 mm, which correspond to a cold-rolled steel sheet described in JIS G 3141:2021, were immersed in a plating bath having the composition shown in Table 1 to obtain plated steel sheets (O1 to O7) having an adhesion amount (per surface) shown in Table 10. In Table 1, for example, Zn-0.2% Al indicates that the composition contains 0.2 mass % of Al and a remainder including Zn and impurities.

In addition, water-based surface treatment metal agents ST1 to ST19 obtained by mixing the silicon compounds (silane coupling agents), phosphorus compounds, fluorine compounds, zirconium compounds, vanadium compounds, zinc compounds, carboxylic acids, and aluminum compounds shown in Tables 2 to 9 in the ratios shown in Tables 11-1 and 11-2 were prepared.

The surface treatment metal agents of STI to ST19 were applied to the plated steel sheets O1 to O7 with a roll coater and dried to form a coating. Here, the adhesion amount of the coating and the combination of the plated steel sheets and the surface treatment metal agents were set as shown in Table 12 and Tables 13-1 to 13-16. The coating formation was controlled by the temperature history shown in Table 12 and Table 13-1 to 13-16.

As a result, surface-treated steel sheets No. 1 to 187 were manufactured.

The obtained surface-treated steel sheets were evaluated for corrosion resistance, coating adhesion, alkali resistance, powdering resistance, corrosion resistance in an outdoor exposure environment, and external appearance in the following manner.

At the same time, in the same manner as described above, the ratio between the integrated intensities, the Zn concentration, and the Al concentration were measured by the XPS analysis of the surface of the coating, and the Si concentration, the P concentration, the F concentration, the V concentration, the Zr concentration, the ratio of the maximum value of the P concentration to the average P concentration (including the position of the P-enriched layer), the ratio of the maximum value of the F concentration to the average F concentration (including the position of the P-enriched layer) were measured by TEM-EDS analysis of the cross section in the thickness direction.

The measurement results are shown in Tables 13-1 to 13-16. Although not shown in the tables, in examples in which the ratio of the maximum value to the average concentration was higher than 1.00, all the P-enriched layers or the F-enriched layers were present adjacent to the interface with the plating layer.

<Corrosion Resistance (SST)>

A flat sheet test piece was prepared, and each test piece was subjected to a salt spray test according to JIS Z 2371:2015, and evaluated for a state of occurrence of white rust (a ratio of an area where white rust had occurred to an area of the test piece) on the surface after 168 hours and after 240 hours.

<Evaluation Criteria>

○: Rust had occurred in less than 10% of the total area

Δ: Rust had occurred in 10% or more and less than 30% of the total area

×: Rust had occurred in 30% or more of the total area

A case where a state of occurrence of white rust after at least 168 hours was ○ was determined to be excellent in corrosion resistance.

"Corrosion Resistance of Erichsen Processed Portion"

A flat sheet test piece was prepared, subjected to an Erichsen test (7 mm extrusion), and then subjected to a salt spray test according to JIS Z 2371:2015 for 72 hours, and a white rust occurrence state was observed.

<Evaluation Criteria>

○: Rust had occurred in less than 10% of the area of the processed portion

Δ: Rust had occurred in 10% or more and less than 30% of the area of the processed portion ×: Rust had occurred in 30% or more of the area of the processed portion A case where rust had occurred in less than 10% of the area of the processed portion (evaluated as ○) was determined to be excellent in the corrosion resistance of the Erichsen processed portion.

<Coating Adhesion>

A flat sheet test piece was prepared, and a white paint (Amylac#1000) was applied so that the film thickness after drying was 20 μm. This test piece was immersed in boiling water for 30 minutes, cuts were made in a grid pattern at intervals of 1 mm, and adhesion was evaluated based on a remaining number proportion (remaining number/number of cuts: 100). Specifically, the adhesion was evaluated by a ratio of no coating peeling to 100 grids.

<Evaluation Criteria>

○: 95% or more

Δ: 90% or more and less than 95%

×: less than 90%

When the adhesion was evaluated as ○, it was determined that the coating adhesion was excellent.

<Alkali Resistance>

An alkaline degreasing agent (FC-E6406, manufactured by Nihon Parkerizing Co., Ltd.) was dissolved in water and adjusted to pH=12 to obtain an alkaline degreasing liquid. The alkaline degreasing liquid was heated to 55° C., and a test sheet having a size of a 100 mm×100 mm (× sheet thickness) was immersed for 2 minutes. The test sheet after being immersed in the alkaline degreasing liquid was sufficiently washed with water, water droplets were removed with air, and the test sheet was stored in a thermostat at 25° C. for 30 minutes to be dried.

Thereafter, white paint (Amylac #1000) was applied so that the film thickness after drying was 20 μm. This test piece was immersed in boiling water for 30 minutes. cuts were made in a grid pattern at intervals of 1 mm, and adhesion was evaluated based on a remaining number proportion (remaining number/number of cuts: 100). Specifically, the adhesion was evaluated by a ratio of no coating peeling to 100 grids.

<Evaluation Criteria>

◎: 100%

○: 95% or more

Δ: 90% or more and less than 95%

×: less than 90%

<Powdering Resistance>

A flat sheet test piece was prepared, and subjected to close contact bending according to JIS Z 2248:2006, and a cellophane tape peeling test of the close contact bent portion was conducted. Thereafter, a cellophane tape peeled portion was observed with a scanning electron microscope, and a residual state of the coating was evaluated.

<Evaluation Criteria>

○: No peeling of the coating film was observed.

×: Peeling of the coating film was observed.

<Outdoor Exposure Corrosion Resistance >

A flat sheet test piece was prepared, subjected to a test for resistance to accelerated weathering using a xenon lamp method specified in JIS K 5600-7-7 (ISO 11341:2004) for 300 hours, then subjected to a salt spray test according to JIS Z 2371:2015, and evaluated for a state of occurrence of white rust (a ratio of an area where white rust had occurred to an area of the test piece) on the surface after 120 hours.

<Evaluation Criteria>

◎: Rust had occurred in less than 3% of the total area

○: Rust had occurred in 3% or more and less than 10% of the total area

Δ: Rust had occurred in 10% or more and less than 30% of the total area

×: Rust had occurred in 30% or more of the total area

<External Appearance>

An external appearance of the flat sheet test piece was visually evaluated according to the following criteria.

<Evaluation Criteria>

○: Presence of a local white portion was not observed

×: Presence of a local white portion was observed

TABLE 1

| | Plating composition |
|---|---|
| A | Zn-0.2% Al |
| B | Zn-0.2% Al-0.08% Sb |
| C | Zn-6.0% Al-3.0% Mg |
| D | Zn-11.0% Al-3.0% Mg-0.2% Si |
| E | Zn-16.0% Al-6.0% Mg-0.2% Si |
| F | Zn-19.0% Al-6.0% Mg-1.5% Sn-0.5% Ca-0.2% Si |
| G | Zn-24.0% Al-12.0% Mg-0.5% Ca-1.2% Si |

TABLE 2

| | Name |
|---|---|
| A1 | 3-aminopropyltrimethoxysilane |
| A2 | 3-aminopropyltriethoxysilane |
| B1 | 3-glycidoxypropyltrimethoxysilane |
| B2 | 3-glycidoxypropyltriethoxysilane |

TABLE 3

| | Name |
|---|---|
| T1 | Phosphoric acid |
| T2 | Ammonium phosphate |

TABLE 4

| | Name |
|---|---|
| U1 | Hydrogen fluoride |
| U2 | Hydroacid titanium fluoride |

TABLE 5

| | Name |
|---|---|
| V1 | Ammonium zirconium carbonate |
| V2 | Hydroacid zirconium hexafluoride |

TABLE 6

| | Name |
|---|---|
| W1 | Vanadium oxysulfate $VOSO_4$ |
| W2 | Vanadyl oxyacetylacetonate $VO(OC(=CH_2)CH_2COCH_3)$ |

TABLE 7

| | Name |
|---|---|
| X1 | Zinc sulfate |
| X2 | Zinc fluoride |

TABLE 8

| | Name |
|---|---|
| Y1 | Formic acid |
| Y2 | Acetic acid |

TABLE 9

| | Name |
|---|---|
| Z1 | Aluminum hydroxide |
| Z2 | Aluminum sulfate |

TABLE 10

| | | Plating | |
|---|---|---|---|
| No. | Sheet thickness (mm) | Type | Adhesion amount ($g/m^2$) |
| 01 | 0.8 | A | 90 |
| 02 | 0.8 | B | 90 |
| 03 | 0.8 | C | 90 |
| 04 | 0.8 | D | 90 |
| 05 | 0.8 | E | 90 |
| 06 | 0.8 | F | 90 |
| 07 | 0.8 | G | 90 |

TABLE 11-1

| | Organic silicon compound (S) | | | P compound (T) | | F compound (U) | | Zr compound (V) | |
|---|---|---|---|---|---|---|---|---|---|
| | Silane coupling agent | | Ratio | | Ratio | | Ratio | | Ratio |
| No. | A | B | A/B | Type | Ts/Ss | Type | Us/Ss | Type | Vs/Ss |
| ST1 | A1 | B1 | 0.8 | T1 | 0.16 | U1 | 0.29 | V2 | 0.12 |
| ST2 | A1 | B2 | 1.3 | T1 | 0.30 | U2 | 0.24 | V2 | 0.14 |
| ST3 | A2 | B1 | 1.5 | T2 | 0.28 | U1 | 0.18 | V1 | 0.06 |
| ST4 | A2 | B2 | 1.2 | T2 | 0.16 | U2 | 0.05 | V1 | 0.07 |
| ST5 | A1 | B1 | 0.6 | T2 | 0.29 | U2 | 0.16 | V1 | 0.09 |
| ST6 | A1 | B2 | 0.8 | T2 | 0.22 | U1 | 0.02 | V1 | 0.09 |
| ST7 | A2 | B1 | 1.1 | T1 | 0.20 | U2 | 0.22 | V2 | 0.14 |
| ST8 | A2 | B2 | 1.6 | T1 | 0.24 | U1 | 0.24 | V2 | 0.14 |
| ST9 | A1 | B1 | 1.3 | T1 | 0.30 | U1 | 0.24 | V1 | 0.08 |
| ST10 | A1 | B2 | 1.4 | T1 | 0.17 | U2 | 0.11 | V1 | 0.06 |
| ST11 | A2 | B1 | 0.6 | T2 | 0.17 | U1 | 0.16 | V2 | 0.08 |
| ST12 | A2 | B2 | 1.2 | T2 | 0.22 | U2 | 0.17 | V2 | 0.10 |
| ST13 | A1 | B1 | 0.8 | T1 | 0.17 | U1 | 0.02 | V1 | 0.07 |
| ST14 | A1 | B2 | 0.7 | T2 | 0.29 | U2 | 0.23 | V2 | 0.08 |
| ST15 | A2 | B1 | 1.5 | T2 | 0.28 | U2 | 0.03 | V2 | 0.13 |
| ST16 | A2 | B2 | 1.1 | T1 | 0.16 | U1 | 0.16 | V1 | 0.13 |
| ST17 | A1 | B2 | 1.1 | T1 | 0.22 | U2 | 0.16 | V1 | 0.11 |
| ST18 | A2 | A1 | 1.3 | T2 | 0.23 | U1 | 0.16 | V2 | 0.10 |
| ST19 | A1 | B2 | 1.3 | T1 | 0.22 | U2 | 0.16 | V1 | 0.11 |

TABLE 11-2

| | V compound (W) | | Zn compound (X) | | | Carboxylic acid (Y) | | Al compound (Z) | |
|---|---|---|---|---|---|---|---|---|---|
| No. | Type | Ratio Ws/Ss | Type | Ratio Xs/Ss | Ratio Xs/NVs | Type | Ratio Ymol/Smol | Type | Ratio Zs/NVs |
| ST1 | W2 | 0.06 | X1 | 0.03 | 0.0005 | Y2 | 5.6 | — | — |
| ST2 | W1 | 0.12 | X1 | 0.04 | 0.0007 | Y1 | 1.5 | — | — |
| ST3 | W2 | 0.10 | X2 | 0.03 | 0.0005 | Y2 | 8.3 | — | — |
| ST4 | W1 | 0.12 | X2 | 0.25 | 0.0023 | Y1 | 0.2 | — | — |
| ST5 | W1 | 0.06 | X1 | 0.31 | 0.0290 | Y1 | 9.8 | — | — |
| ST6 | W2 | 0.06 | X2 | 0.17 | 0.0150 | Y2 | 3.6 | — | — |
| ST7 | W1 | 0.16 | X1 | 0.04 | 0.0004 | Y1 | 1.6 | Z1 | 0.0020 |
| ST8 | W2 | 0.15 | X2 | 0.09 | 0.0007 | Y2 | 6.7 | Z2 | 0.0283 |
| ST9 | W1 | 0.07 | X1 | 0.06 | 0.0005 | Y2 | 3.7 | Z1 | 0.0151 |
| ST10 | W2 | 0.08 | X1 | 0.06 | 0.0050 | Y1 | 4.1 | Z2 | 0.0149 |
| ST11 | W1 | 0.08 | X2 | 0.25 | 0.0222 | Y2 | 5.2 | Z1 | 0.0031 |
| ST12 | W2 | 0.10 | X2 | 0.16 | 0.0133 | Y1 | 0.3 | Z2 | 0.0184 |
| ST13 | W1 | 0.12 | X1 | 0.005 | 0.00004 | Y1 | 3.8 | — | — |
| ST14 | W2 | 0.08 | X2 | 0.03 | 0.0005 | Y2 | 0.05 | — | — |
| ST15 | W2 | 0.13 | X2 | 0.31 | 0.0290 | Y1 | 0.03 | — | — |
| ST16 | W2 | 0.15 | X1 | 0.49 | 0.0310 | Y1 | 0.5 | — | — |
| ST17 | W1 | 0.13 | X1 | 0.35 | 0.0287 | Y2 | 0.8 | Z1 | 0.0005 |
| ST18 | W1 | 0.13 | X2 | 0.20 | 0.0133 | Y1 | 1.0 | Z2 | 0.0450 |
| ST19 | W1 | 0.13 | X1 | 0 | 0.0000 | Y2 | 0.8 | Z1 | 0.0005 |

TABLE 12

| | Application conditions | | Preliminary treatment | | | Main treatment | |
|---|---|---|---|---|---|---|---|
| No. | Coating adhesion amount ($mg/m^2$) | Temperature of surface treatment metal agent (° C.) | Time for which steel sheet temperature is 30° C. or higher and lower than 50° C. (sec) | Time until steel sheet temperature reaches 40° C. (sec) | Time for which steel sheet temperature is 40° C. or higher and lower than 50° C. (sec) | Maximum attainment temperature (° C.) | Holding time at 55° C. to 180° C. (sec) |
| C1 | 0.24 | 15 | 7.0 | 7.1 | 0.0 | 55 | 13 |
| C2 | 1.70 | 20 | 8.5 | 8.2 | 0.3 | 80 | 8 |
| C3 | 0.07 | 25 | 4.0 | 3.8 | 0.3 | 110 | 5 |
| C4 | 0.65 | 25 | 5.3 | 4.9 | 0.4 | 150 | 14 |
| C5 | 1.30 | 15 | 6.0 | 6.1 | 0.0 | 175 | 10 |
| C6 | 1.70 | 20 | 6.2 | 5.1 | 0.1 | 30 | 0 |
| C7 | 0.88 | 25 | 10.0 | 9.8 | 0.2 | 40 | 0 |
| C8 | 0.25 | 25 | 8.8 | 9.2 | 0.0 | 35 | 0 |
| C9 | 0.60 | 15 | 9.1 | 9.1 | 0.0 | 200 | 4 |
| C10 | 0.45 | 20 | 8.0 | 8.5 | 0.0 | 215 | 13 |
| C11 | 0.30 | 25 | 7.5 | 7.8 | 0.3 | 190 | 25 |
| C12 | 0.60 | 25 | 9.5 | 9.3 | 0.4 | 60 | 2 |
| C13 | 0.75 | 15 | 10.5 | 10.5 | 0.0 | 130 | 30 |
| C14 | 0.86 | 20 | 0.1 | 0.2 | 5.3 | 60 | 14 |
| C15 | 0.32 | 25 | 0.1 | 0.2 | 0.2 | 120 | 13 |
| C16 | 0.47 | 25 | 5.1 | 4.6 | 0.5 | 135 | 12 |
| C17 | 0.56 | 25 | 4.0 | 0.2 | 3.8 | 100 | 7 |
| C18 | 1.02 | 20 | 31.0 | 1.2 | 30.0 | 80 | 5 |
| C19 | 0.38 | 15 | 28.3 | 2.5 | 26.0 | 180 | 14 |
| C20 | 0.55 | 30 | 9.0 | 9.1 | 0.1 | 70 | 9 |
| C21 | 0.87 | 40 | 5.5 | 6.0 | 0.2 | 70 | 11 |
| C22 | 0.76 | 55 | 1.1 | 0.7 | 0.3 | 70 | 11 |
| C23 | 0.46 | 35 | 4.5 | 0.3 | 4.2 | 85 | 12 |
| C24 | 0.43 | 35 | 16.3 | 16.0 | 0.3 | 90 | 15 |
| C25 | 0.48 | 30 | 5.5 | 4.7 | 1.0 | 115 | 5 |
| C26 | 0.90 | 40 | 6.0 | 6.3 | 2.3 | 130 | 13 |

TABLE 13-1

| | Manufacturing conditions | | | XPS analysis | | | TEM-EDS analysis | | | | | | |
|---|---|---|---|---|---|---|---|---|---|---|---|---|---|
| No. | Sample base sheet | Surface treatment metal agent | Application and drying conditions | XPS peak ratio | Zn concentration (mass %) | Al concentration (mass %) | Si concentration (mass %) | P concentration (mass %) | F concentration (mass %) | V concentration (mass %) | Zr concentration (mass %) | Ratio of maximum value of P concentration to average P concentration | Ratio of maximum value of F concentration to average F concentration |
| 1 | 01 | ST1 | C1 | 0.06 | 0.05 | 0.00 | 10.58 | 4.07 | 0.27 | 0.51 | 0.31 | 1.07 | 1.09 |
| 2 | 01 | ST2 | C2 | 0.08 | 0.07 | 0.00 | 13.57 | 3.41 | 0.13 | 2.55 | 0.73 | 1.09 | 1.07 |
| 3 | 01 | ST3 | C3 | 0.10 | 0.05 | 0.00 | 10.35 | 0.86 | 0.98 | 1.27 | 0.34 | 1.05 | 0.95 |
| 4 | 01 | ST1 | C4 | 0.13 | 0.04 | 0.00 | 10.71 | 0.38 | 1.02 | 2.97 | 0.38 | 1.01 | 1.15 |
| 5 | 01 | ST2 | C5 | 0.15 | 0.06 | 0.00 | 12.51 | 1.90 | 0.90 | 3.69 | 0.89 | 0.96 | 1.06 |
| 6 | 01 | ST3 | C1 | 0.07 | 0.05 | 0.00 | 16.43 | 2.58 | 1.15 | 0.88 | 0.74 | 0.91 | 1.02 |
| 7 | 01 | ST1 | C2 | 0.08 | 0.05 | 0.00 | 10.38 | 0.02 | 1.30 | 3.38 | 0.87 | 1.00 | 0.90 |
| 8 | 01 | ST2 | C3 | 0.09 | 0.08 | 0.00 | 16.49 | 0.37 | 1.93 | 3.43 | 0.10 | 1.15 | 1.18 |
| 9 | 01 | ST3 | C4 | 0.12 | 0.06 | 0.00 | 10.00 | 4.49 | 0.02 | 1.60 | 0.43 | 1.11 | 1.11 |
| 10 | 01 | ST1 | C5 | 0.12 | 0.05 | 0.00 | 16.54 | 4.79 | 0.92 | 1.71 | 0.40 | 0.96 | 1.04 |
| 11 | 01 | ST2 | C1 | 0.05 | 0.05 | 0.00 | 19.35 | 1.89 | 0.89 | 3.50 | 0.24 | 0.94 | 0.94 |
| 12 | 01 | ST3 | C2 | 0.07 | 0.03 | 0.00 | 14.19 | 1.83 | 1.53 | 0.13 | 0.31 | 1.11 | 1.00 |
| 13 | 01 | ST1 | C3 | 0.09 | 0.06 | 0.00 | 16.76 | 0.26 | 1.63 | 2.50 | 0.31 | 0.94 | 1.17 |
| 14 | 01 | ST2 | C4 | 0.13 | 0.08 | 0.00 | 15.26 | 2.34 | 0.42 | 1.62 | 0.13 | 1.06 | 0.94 |
| 15 | 01 | ST3 | C5 | 0.17 | 0.05 | 0.00 | 19.62 | 1.54 | 0.99 | 2.75 | 0.41 | 1.14 | 1.13 |
| 16 | 02 | ST1 | C1 | 0.05 | 0.05 | 0.00 | 15.73 | 3.70 | 1.65 | 1.94 | 0.57 | 0.95 | 0.93 |
| 17 | 03 | ST2 | C2 | 0.04 | 0.07 | 0.00 | 16.97 | 2.21 | 1.25 | 0.45 | 0.60 | 0.98 | 1.03 |
| 18 | 04 | ST3 | C3 | 0.08 | 0.06 | 0.00 | 16.75 | 0.66 | 1.25 | 3.63 | 0.30 | 1.13 | 1.16 |
| 19 | 05 | ST1 | C4 | 0.10 | 0.06 | 0.00 | 16.33 | 4.45 | 0.54 | 3.20 | 0.49 | 1.00 | 0.97 |
| 20 | 06 | ST2 | C5 | 0.15 | 0.06 | 0.00 | 17.06 | 4.22 | 0.55 | 0.80 | 0.82 | 1.19 | 1.01 |
| 21 | 07 | ST3 | C1 | 0.06 | 0.06 | 0.00 | 17.77 | 3.59 | 1.94 | 0.61 | 0.12 | 0.98 | 1.17 |

TABLE 13-1-continued

| | Manufacturing conditions | | | XPS analysis | | | TEM-EDS analysis | | | | | | |
|---|---|---|---|---|---|---|---|---|---|---|---|---|---|
| No. | Sample base sheet | Surface treatment metal agent | Application and drying conditions | XPS peak ratio | Zn concentration (mass %) | Al concentration (mass %) | Si concentration (mass %) | P concentration (mass %) | F concentration (mass %) | V concentration (mass %) | Zr concentration (mass %) | Ratio of maximum value of P concentration to average P concentration | Ratio of maximum value of F concentration to average F concentration |
| 22 | 01 | ST1 | C6 | 0.01 | 0.04 | 0.00 | 10.38 | 2.12 | 0.56 | 3.63 | 0.55 | 1.07 | 0.96 |
| 23 | 01 | ST2 | C7 | 0.01 | 0.07 | 0.00 | 11.00 | 3.53 | 0.23 | 3.87 | 0.53 | 1.13 | 1.15 |
| 24 | 01 | ST3 | C8 | 0.02 | 0.05 | 0.00 | 14.64 | 0.17 | 0.62 | 1.27 | 0.33 | 0.94 | 0.92 |

TABLE 13-2

| | Manufacturing conditions | | | XPS analysis | | | TEM-EDS analysis | | | | | | |
|---|---|---|---|---|---|---|---|---|---|---|---|---|---|
| No. | Sample base sheet | Surface treatment metal agent | Application and drying conditions | XPS peak ratio | Zn concentration (mass %) | Al concentration (mass %) | Si concentration (mass %) | P concentration (mass %) | F concentration (mass %) | V concentration (mass %) | Zr concentration (mass %) | Ratio of maximum value of P concentration to average P concentration | Ratio of maximum value of F concentration to average F concentration |
| 25 | 01 | ST1 | C9 | 0.28 | 0.05 | 0.00 | 10.84 | 0.82 | 1.91 | 2.28 | 0.47 | 0.96 | 1.07 |
| 26 | 01 | ST2 | C10 | 0.33 | 0.09 | 0.00 | 15.40 | 3.31 | 0.84 | 1.44 | 0.37 | 0.93 | 1.06 |
| 27 | 01 | ST3 | C11 | 0.36 | 0.07 | 0.00 | 17.85 | 4.81 | 1.63 | 3.48 | 0.25 | 0.94 | 1.08 |
| 28 | 01 | ST1 | C12 | 0.03 | 0.05 | 0.00 | 19.75 | 3.23 | 1.44 | 0.30 | 0.52 | 0.98 | 1.19 |
| 29 | 01 | ST2 | C13 | 0.28 | 0.05 | 0.00 | 11.24 | 3.40 | 1.16 | 2.02 | 0.27 | 1.04 | 1.10 |
| 30 | 01 | ST4 | C2 | 0.05 | 0.23 | 0.00 | 16.61 | 3.67 | 0.81 | 1.76 | 0.67 | 1.04 | 0.96 |
| 31 | 01 | ST5 | C3 | 0.08 | 2.91 | 0.00 | 13.91 | 0.46 | 1.65 | 3.06 | 0.69 | 0.98 | 1.03 |
| 32 | 01 | ST6 | C4 | 0.12 | 1.48 | 0.00 | 12.63 | 0.21 | 1.90 | 0.13 | 0.15 | 0.97 | 1.07 |
| 33 | 01 | ST4 | C5 | 0.23 | 0.22 | 0.00 | 13.70 | 1.64 | 0.94 | 3.68 | 0.39 | 0.94 | 0.97 |
| 34 | 01 | ST5 | C1 | 0.05 | 2.88 | 0.00 | 17.19 | 0.65 | 0.15 | 0.88 | 0.89 | 1.14 | 1.02 |
| 35 | 01 | ST6 | C2 | 0.07 | 1.55 | 0.00 | 11.79 | 1.38 | 1.30 | 2.91 | 0.56 | 1.14 | 0.95 |
| 36 | 01 | ST4 | C3 | 0.13 | 0.19 | 0.00 | 15.21 | 1.29 | 1.47 | 1.04 | 0.70 | 0.91 | 1.08 |
| 37 | 01 | ST5 | C4 | 0.15 | 2.70 | 0.00 | 10.57 | 2.56 | 1.47 | 3.86 | 0.16 | 1.10 | 1.13 |
| 38 | 01 | ST6 | C5 | 0.15 | 1.40 | 0.00 | 17.35 | 0.12 | 0.82 | 1.92 | 0.45 | 1.12 | 1.01 |
| 39 | 02 | ST4 | C1 | 0.04 | 0.25 | 0.00 | 18.57 | 4.43 | 1.51 | 1.20 | 0.22 | 1.17 | 1.07 |
| 40 | 03 | ST5 | C2 | 0.09 | 2.88 | 0.00 | 12.00 | 2.24 | 1.01 | 1.25 | 0.44 | 1.14 | 1.08 |
| 41 | 04 | ST6 | C3 | 0.09 | 1.41 | 0.00 | 18.89 | 2.39 | 0.95 | 0.75 | 0.42 | 1.16 | 1.07 |
| 42 | 05 | ST4 | C4 | 0.15 | 0.23 | 0.00 | 15.62 | 4.82 | 0.19 | 2.68 | 0.58 | 1.17 | 1.16 |
| 43 | 06 | ST5 | C5 | 0.18 | 2.90 | 0.00 | 10.75 | 0.41 | 0.26 | 0.41 | 0.77 | 1.19 | 1.12 |
| 44 | 07 | ST6 | C1 | 0.05 | 1.50 | 0.00 | 12.14 | 0.71 | 0.31 | 1.18 | 0.84 | 1.05 | 0.94 |
| 45 | 01 | ST4 | C6 | 0.01 | 0.22 | 0.00 | 17.30 | 3.51 | 1.76 | 0.80 | 0.58 | 1.07 | 0.90 |
| 46 | 02 | ST5 | C7 | 0.01 | 2.90 | 0.00 | 17.41 | 3.87 | 0.84 | 1.14 | 0.22 | 1.01 | 1.05 |
| 47 | 03 | ST6 | C8 | 0.03 | 1.48 | 0.00 | 16.42 | 1.60 | 0.16 | 3.59 | 0.37 | 0.90 | 0.95 |
| 48 | 04 | ST4 | C9 | 0.27 | 0.23 | 0.00 | 18.53 | 3.21 | 1.73 | 3.15 | 0.64 | 0.94 | 1.05 |

TABLE 13-3

| | Manufacturing conditions | | | XPS analysis | | | TEM-EDS analysis | | | | | | |
|---|---|---|---|---|---|---|---|---|---|---|---|---|---|
| No. | Sample base sheet | Surface treatment metal agent | Application and drying conditions | XPS peak ratio | Zn concentration (mass %) | Al concentration (mass %) | Si concentration (mass %) | P concentration (mass %) | F concentration (mass %) | V concentration (mass %) | Zr concentration (mass %) | Ratio of maximum value of P concentration to average P concentration | Ratio of maximum value of F concentration to average F concentration |
| 49 | 05 | ST5 | C10 | 0.30 | 2.88 | 0.00 | 16.57 | 4.52 | 1.51 | 3.40 | 0.53 | 0.95 | 1.17 |
| 50 | 06 | ST6 | C11 | 0.33 | 1.54 | 0.00 | 17.20 | 1.34 | 1.02 | 0.79 | 0.25 | 1.02 | 0.97 |
| 51 | 07 | ST4 | C12 | 0.02 | 0.19 | 0.00 | 13.44 | 0.20 | 0.53 | 2.84 | 0.66 | 1.16 | 1.08 |
| 52 | 01 | ST5 | C13 | 0.29 | 2.70 | 0.00 | 18.78 | 4.61 | 0.89 | 1.85 | 0.36 | 1.03 | 1.03 |
| 53 | 01 | ST7 | C3 | 0.07 | 0.04 | 0.20 | 10.66 | 1.39 | 1.49 | 1.46 | 0.18 | 1.01 | 0.99 |
| 54 | 01 | ST8 | C4 | 0.11 | 0.07 | 2.80 | 14.57 | 3.01 | 1.00 | 2.08 | 0.20 | 0.94 | 1.09 |
| 55 | 01 | ST9 | C5 | 0.24 | 0.05 | 1.51 | 19.95 | 3.18 | 0.19 | 0.11 | 0.85 | 1.01 | 1.13 |
| 56 | 01 | ST7 | C1 | 0.04 | 0.04 | 0.18 | 13.67 | 2.78 | 0.74 | 2.76 | 0.87 | 1.16 | 1.08 |
| 57 | 01 | ST8 | C2 | 0.06 | 0.08 | 2.87 | 19.27 | 4.47 | 1.73 | 2.39 | 0.46 | 1.07 | 1.05 |
| 58 | 01 | ST9 | C3 | 0.13 | 0.06 | 1.33 | 10.52 | 3.26 | 1.07 | 0.53 | 0.85 | 0.92 | 1.17 |
| 59 | 01 | ST7 | C4 | 0.15 | 0.05 | 0.30 | 10.27 | 0.83 | 0.85 | 2.15 | 0.22 | 0.91 | 1.05 |
| 60 | 01 | ST8 | C5 | 0.17 | 0.07 | 2.61 | 13.79 | 1.14 | 0.81 | 1.37 | 0.49 | 0.93 | 0.92 |
| 61 | 01 | ST9 | C1 | 0.04 | 0.04 | 1.49 | 17.35 | 0.57 | 1.03 | 2.28 | 0.57 | 0.94 | 0.95 |
| 62 | 02 | ST7 | C2 | 0.09 | 0.04 | 0.26 | 11.55 | 2.16 | 1.36 | 3.61 | 0.46 | 0.99 | 1.03 |
| 63 | 03 | ST8 | C3 | 0.10 | 0.08 | 2.77 | 10.69 | 4.25 | 0.86 | 2.74 | 0.46 | 1.10 | 0.92 |
| 64 | 04 | ST9 | C4 | 0.15 | 0.05 | 1.50 | 14.71 | 0.56 | 0.14 | 3.73 | 0.19 | 1.13 | 1.10 |
| 65 | 05 | ST7 | C5 | 0.24 | 0.01 | 0.20 | 10.22 | 1.64 | 1.18 | 0.83 | 0.71 | 0.97 | 1.00 |
| 66 | 06 | ST8 | C1 | 0.05 | 0.08 | 2.80 | 16.35 | 3.29 | 0.13 | 3.54 | 0.77 | 1.11 | 1.00 |
| 67 | 07 | ST9 | C2 | 0.08 | 0.06 | 1.49 | 19.69 | 2.50 | 0.08 | 2.35 | 0.75 | 1.07 | 0.94 |
| 68 | 01 | ST7 | C6 | 0.01 | 0.03 | 0.19 | 15.70 | 4.23 | 0.32 | 3.68 | 0.52 | 1.13 | 0.95 |
| 69 | 02 | ST8 | C7 | 0.01 | 0.06 | 2.79 | 18.88 | 3.29 | 1.65 | 2.65 | 0.17 | 1.05 | 1.03 |
| 70 | 03 | ST9 | C8 | 0.03 | 0.06 | 1.51 | 11.46 | 0.53 | 0.68 | 1.02 | 0.15 | 1.18 | 0.90 |
| 71 | 04 | ST7 | C9 | 0.27 | 0.06 | 0.18 | 18.40 | 2.71 | 1.88 | 1.67 | 0.11 | 1.10 | 0.93 |
| 72 | 05 | ST8 | C10 | 0.30 | 0.08 | 2.66 | 13.10 | 3.49 | 1.61 | 2.47 | 0.78 | 0.92 | 1.06 |

TABLE 13-4

| | Manufacturing conditions | | | XPS analysis | | | TEM-EDS analysis | | | | | | |
|---|---|---|---|---|---|---|---|---|---|---|---|---|---|
| No. | Sample base sheet | Surface treatment metal agent | Application and drying conditions | XPS peak ratio | Zn concentration (mass %) | Al concentration (mass %) | Si concentration (mass %) | P concentration (mass %) | F concentration (mass %) | V concentration (mass %) | Zr concentration (mass %) | Ratio of maximum value of P concentration to average P concentration | Ratio of maximum value of F concentration to average F concentration |
| 73 | 06 | ST9 | C11 | 0.35 | 0.06 | 1.33 | 18.37 | 3.85 | 0.58 | 0.65 | 0.26 | 0.96 | 1.06 |
| 74 | 07 | ST7 | C12 | 0.01 | 0.05 | 0.25 | 15.26 | 1.89 | 1.94 | 1.14 | 0.21 | 0.97 | 1.09 |
| 75 | 01 | ST8 | C13 | 0.31 | 0.07 | 2.81 | 17.06 | 0.58 | 0.88 | 3.23 | 0.47 | 1.11 | 1.11 |
| 76 | 01 | ST10 | C4 | 0.11 | 0.50 | 1.50 | 19.09 | 4.67 | 1.43 | 3.36 | 0.16 | 0.96 | 0.91 |
| 77 | 01 | ST11 | C5 | 0.23 | 2.22 | 0.30 | 17.17 | 4.12 | 0.10 | 2.16 | 0.64 | 1.18 | 1.04 |
| 78 | 01 | ST12 | C1 | 0.05 | 1.32 | 1.80 | 14.41 | 2.68 | 0.47 | 2.95 | 0.12 | 0.99 | 1.02 |
| 79 | 01 | ST10 | C2 | 0.07 | 0.49 | 1.49 | 12.29 | 4.32 | 0.69 | 0.79 | 0.44 | 1.00 | 1.16 |
| 80 | 01 | ST11 | C3 | 0.14 | 2.11 | 0.35 | 15.85 | 1.38 | 1.34 | 0.35 | 0.89 | 1.08 | 1.09 |
| 81 | 01 | ST12 | C4 | 0.15 | 1.28 | 2.01 | 19.42 | 0.20 | 1.71 | 2.04 | 0.87 | 0.93 | 0.91 |

TABLE 13-4-continued

| | Manufacturing conditions | | | XPS analysis | | | TEM-EDS analysis | | | | | | |
|---|---|---|---|---|---|---|---|---|---|---|---|---|---|
| No. | Sample base sheet | Surface treatment metal agent | Application and drying conditions | XPS peak ratio | Zn concentration (mass %) | Al concentration (mass %) | Si concentration (mass %) | P concentration (mass %) | F concentration (mass %) | V concentration (mass %) | Zr concentration (mass %) | Ratio of maximum value of P concentration to average P concentration | Ratio of maximum value of F concentration to average F concentration |
| 82 | 01 | ST10 | C5 | 0.18 | 0.48 | 1.61 | 17.77 | 2.73 | 1.64 | 1.25 | 0.81 | 0.94 | 0.97 |
| 83 | 01 | ST11 | C1 | 0.04 | 2.13 | 0.40 | 13.90 | 4.77 | 0.96 | 0.74 | 0.76 | 1.04 | 0.93 |
| 84 | 01 | ST12 | C2 | 0.09 | 1.45 | 1.85 | 16.71 | 1.81 | 1.71 | 2.20 | 0.48 | 1.00 | 1.02 |
| 85 | 02 | ST10 | C3 | 0.10 | 0.49 | 1.71 | 10.47 | 1.66 | 0.89 | 2.72 | 0.89 | 0.92 | 1.06 |
| 86 | 03 | ST11 | C4 | 0.16 | 2.15 | 0.20 | 17.96 | 2.13 | 1.08 | 0.93 | 0.14 | 1.17 | 1.12 |
| 87 | 04 | ST12 | C5 | 0.23 | 0.39 | 1.90 | 19.19 | 1.75 | 1.63 | 2.17 | 0.43 | 0.95 | 1.04 |
| 88 | 05 | ST10 | C1 | 0.05 | 0.60 | 1.45 | 16.51 | 4.59 | 0.03 | 0.51 | 0.30 | 0.94 | 1.04 |
| 89 | 06 | ST11 | C2 | 0.08 | 2.30 | 0.32 | 10.52 | 3.46 | 0.64 | 0.18 | 0.58 | 1.03 | 0.92 |
| 90 | 07 | ST12 | C3 | 0.09 | 1.50 | 1.90 | 16.99 | 0.95 | 1.69 | 3.16 | 0.79 | 1.18 | 1.18 |
| 91 | 07 | ST10 | C6 | 0.01 | 0.50 | 1.69 | 17.11 | 1.20 | 0.87 | 3.44 | 0.19 | 0.92 | 0.92 |
| 92 | 06 | ST11 | C7 | 0.01 | 2.10 | 0.19 | 19.78 | 0.88 | 0.40 | 2.55 | 0.32 | 1.07 | 1.06 |
| 93 | 05 | ST12 | C8 | 0.02 | 0.46 | 1.89 | 12.78 | 1.36 | 1.03 | 0.75 | 0.70 | 1.03 | 1.06 |
| 94 | 04 | ST10 | C9 | 0.30 | 0.59 | 1.55 | 15.29 | 3.17 | 0.79 | 1.67 | 0.41 | 1.05 | 1.03 |
| 95 | 03 | ST11 | C10 | 0.31 | 2.30 | 0.25 | 17.56 | 0.25 | 1.64 | 0.54 | 0.28 | 1.17 | 1.06 |
| 96 | 02 | ST12 | C11 | 0.35 | 1.51 | 1.89 | 11.52 | 2.20 | 1.59 | 3.48 | 0.68 | 1.06 | 1.05 |

TABLE 13-5

| | Manufacturing conditions | | | XPS analysis | | | TEM-EDS analysis | | | | | | |
|---|---|---|---|---|---|---|---|---|---|---|---|---|---|
| No. | Sample base sheet | Surface treatment metal agent | Application and drying conditions | XPS peak ratio | Zn concentration (mass %) | Al concentration (mass %) | Si concentration (mass %) | P concentration (mass %) | F concentration (mass %) | V concentration (mass %) | Zr concentration (mass %) | Ratio of maximum value of P concentration to average P concentration | Ratio of maximum value of F concentration to average F concentration |
| 97 | 01 | ST10 | C12 | 0.02 | 0.49 | 1.71 | 17.67 | 1.70 | 0.42 | 3.81 | 0.21 | 1.06 | 1.17 |
| 98 | 01 | ST11 | C13 | 0.35 | 2.22 | 0.19 | 19.93 | 3.80 | 1.54 | 1.98 | 0.59 | 0.97 | 1.18 |
| 99 | 01 | ST13 | C1 | 0.01 | 0.00 | 0.00 | 13.75 | 1.30 | 0.15 | 2.61 | 0.18 | 0.95 | 0.99 |
| 100 | 01 | ST13 | C2 | 0.02 | 0.01 | 0.00 | 13.98 | 1.42 | 0.59 | 2.97 | 0.85 | 0.91 | 1.13 |
| 101 | 01 | ST13 | C3 | 0.01 | 0.00 | 0.00 | 12.05 | 4.06 | 1.42 | 1.43 | 0.80 | 1.05 | 1.12 |
| 102 | 01 | ST14 | C4 | 0.01 | 0.05 | 0.00 | 10.96 | 1.08 | 0.04 | 1.38 | 0.43 | 1.06 | 1.04 |
| 103 | 01 | ST14 | C5 | 0.01 | 0.04 | 0.00 | 19.23 | 0.66 | 1.00 | 0.91 | 0.65 | 1.12 | 1.00 |
| 104 | 01 | ST14 | C1 | 0.01 | 0.05 | 0.00 | 14.08 | 1.31 | 0.76 | 2.63 | 0.30 | 1.10 | 1.06 |
| 105 | 01 | ST15 | C2 | 0.01 | 2.90 | 0.00 | 16.01 | 4.30 | 1.99 | 2.03 | 0.75 | 1.02 | 1.01 |
| 106 | 01 | ST15 | C3 | 0.01 | 3.33 | 0.00 | 18.45 | 3.95 | 1.11 | 1.57 | 0.50 | 1.04 | 1.02 |
| 107 | 01 | ST15 | C4 | 0.01 | 3.11 | 0.00 | 19.26 | 0.66 | 0.47 | 1.92 | 0.61 | 1.03 | 0.99 |
| 108 | 01 | ST16 | C5 | 0.24 | 2.97 | 0.00 | 11.14 | 1.82 | 0.68 | 0.13 | 0.78 | 0.90 | 0.96 |
| 109 | 01 | ST16 | C1 | 0.15 | 2.86 | 0.00 | 16.09 | 2.59 | 0.42 | 1.01 | 0.83 | 1.08 | 1.00 |
| 110 | 01 | ST16 | C2 | 0.18 | 2.90 | 0.00 | 16.09 | 4.72 | 1.68 | 1.97 | 0.50 | 1.08 | 0.95 |
| 111 | 01 | ST17 | C3 | 0.13 | 2.70 | 0.05 | 14.01 | 0.25 | 1.44 | 3.06 | 0.79 | 1.17 | 0.96 |
| 112 | 01 | ST17 | C4 | 0.15 | 2.69 | 0.04 | 12.42 | 4.39 | 0.21 | 2.94 | 0.72 | 1.16 | 1.16 |
| 113 | 01 | ST17 | C5 | 0.18 | 2.89 | 0.08 | 10.70 | 4.86 | 1.72 | 3.70 | 0.44 | 1.07 | 1.19 |
| 114 | 01 | ST18 | C1 | 0.06 | 1.33 | 4.36 | 18.27 | 4.82 | 0.67 | 1.31 | 0.43 | 1.07 | 0.99 |
| 115 | 01 | ST18 | C2 | 0.08 | 1.25 | 4.45 | 11.93 | 4.58 | 1.40 | 0.79 | 0.51 | 1.18 | 1.12 |
| 116 | 01 | ST18 | C3 | 0.15 | 1.28 | 4.87 | 18.98 | 2.41 | 1.48 | 3.43 | 0.23 | 0.96 | 1.07 |

TABLE 13-5-continued

| | Manufacturing conditions | | | XPS analysis | | | TEM-EDS analysis | | | | | | |
|---|---|---|---|---|---|---|---|---|---|---|---|---|---|
| No. | Sample base sheet | Surface treatment metal agent | Application and drying conditions | XPS peak ratio | Zn concentration (mass %) | Al concentration (mass %) | Si concentration (mass %) | P concentration (mass %) | F concentration (mass %) | V concentration (mass %) | Zr concentration (mass %) | Ratio of maximum value of P concentration to average P concentration | Ratio of maximum value of F concentration to average F concentration |
| 117 | 01 | ST19 | C4 | 0.01 | 0.00 | 0.04 | 15.82 | 3.39 | 1.56 | 3.15 | 0.15 | 0.95 | 0.98 |
| 118 | 02 | ST19 | C5 | 0.01 | 0.01 | 0.06 | 13.52 | 4.08 | 1.81 | 3.16 | 0.21 | 1.14 | 0.95 |
| 119 | 01 | ST1 | C14 | 0.01 | 0.05 | 0.00 | 17.08 | 3.14 | 1.57 | 3.74 | 0.36 | 1.07 | 1.09 |
| 120 | 01 | ST2 | C15 | 0.01 | 0.04 | 0.00 | 20.00 | 3.93 | 0.34 | 2.73 | 0.35 | 1.07 | 0.94 |

TABLE 13-6

| | Manufacturing conditions | | | XPS analysis | | | TEM-EDS analysis | | | | | | |
|---|---|---|---|---|---|---|---|---|---|---|---|---|---|
| No. | Sample base sheet | Surface treatment metal agent | Application and drying conditions | XPS peak ratio | Zn concentration (mass %) | Al concentration (mass %) | Si concentration (mass %) | P concentration (mass %) | F concentration (mass %) | V concentration (mass %) | Zr concentration (mass %) | Ratio of maximum value of P concentration to average P concentration | Ratio of maximum value of F concentration to average F concentration |
| 121 | 01 | ST3 | C14 | 0.02 | 0.07 | 0.00 | 10.78 | 1.46 | 0.36 | 1.71 | 0.57 | 0.94 | 0.93 |
| 122 | 02 | ST1 | C15 | 0.00 | 0.04 | 0.00 | 11.05 | 1.65 | 0.41 | 3.18 | 0.58 | 1.17 | 1.05 |
| 123 | 03 | ST2 | C14 | 0.01 | 0.03 | 0.00 | 19.59 | 4.21 | 0.57 | 2.18 | 0.50 | 1.18 | 1.17 |
| 124 | 04 | ST3 | C15 | 0.01 | 0.06 | 0.00 | 14.66 | 1.44 | 0.50 | 0.42 | 0.73 | 1.09 | 1.09 |
| 125 | 05 | ST1 | C14 | 0.01 | 0.04 | 0.00 | 15.71 | 0.14 | 1.08 | 2.34 | 0.31 | 0.93 | 1.02 |
| 126 | 06 | ST2 | C15 | 0.03 | 0.04 | 0.00 | 12.97 | 3.88 | 0.56 | 3.57 | 0.61 | 1.10 | 1.00 |
| 127 | 07 | ST3 | C14 | 0.01 | 0.06 | 0.00 | 12.82 | 1.36 | 0.45 | 2.19 | 0.39 | 1.03 | 1.16 |
| 128 | 01 | ST1 | C16 | 0.17 | 0.04 | 0.00 | 16.50 | 1.64 | 0.59 | 0.72 | 0.46 | 1.51 | 0.90 |
| 129 | 01 | ST2 | C17 | 0.15 | 0.07 | 0.00 | 18.64 | 4.23 | 0.86 | 0.89 | 0.26 | 1.36 | 1.07 |
| 130 | 01 | ST3 | C16 | 0.14 | 0.03 | 0.00 | 16.01 | 0.03 | 0.45 | 3.71 | 0.60 | 1.22 | 0.95 |
| 131 | 02 | ST1 | C17 | 0.05 | 0.06 | 0.00 | 12.79 | 3.32 | 1.46 | 2.13 | 0.86 | 2.00 | 0.99 |
| 132 | 03 | ST2 | C16 | 0.18 | 0.03 | 0.00 | 16.17 | 4.37 | 1.70 | 3.54 | 0.89 | 1.33 | 1.16 |
| 133 | 04 | ST3 | C17 | 0.23 | 0.03 | 0.00 | 10.51 | 3.34 | 0.36 | 3.01 | 0.65 | 1.60 | 1.13 |
| 134 | 05 | ST1 | C16 | 0.16 | 0.02 | 0.00 | 10.96 | 3.32 | 1.35 | 2.69 | 0.66 | 1.21 | 1.15 |
| 135 | 06 | ST2 | C17 | 0.15 | 0.05 | 0.00 | 15.69 | 2.29 | 1.59 | 3.87 | 0.28 | 1.88 | 0.97 |
| 136 | 07 | ST3 | C16 | 0.14 | 0.03 | 0.00 | 11.77 | 4.39 | 1.88 | 1.14 | 0.46 | 1.77 | 0.90 |
| 137 | 01 | ST1 | C18 | 0.16 | 0.05 | 0.00 | 10.23 | 1.57 | 1.11 | 3.01 | 0.42 | 2.60 | 1.03 |
| 138 | 01 | ST2 | C19 | 0.18 | 0.03 | 0.00 | 13.65 | 0.52 | 1.44 | 1.38 | 0.30 | 2.33 | 1.06 |
| 139 | 01 | ST3 | C18 | 0.23 | 0.04 | 0.00 | 11.04 | 1.78 | 0.76 | 0.28 | 0.45 | 2.79 | 1.05 |
| 140 | 02 | ST1 | C19 | 0.23 | 0.06 | 0.00 | 18.72 | 3.76 | 0.40 | 2.84 | 0.44 | 2.16 | 1.08 |
| 141 | 03 | ST2 | C18 | 0.05 | 0.05 | 0.00 | 14.79 | 0.39 | 0.77 | 2.45 | 0.57 | 2.05 | 0.94 |
| 142 | 04 | ST3 | C19 | 0.04 | 0.06 | 0.00 | 11.27 | 1.63 | 0.13 | 2.44 | 0.88 | 2.99 | 1.18 |
| 143 | 05 | ST1 | C18 | 0.08 | 0.04 | 0.00 | 15.84 | 2.97 | 1.70 | 2.23 | 0.46 | 3.10 | 0.91 |

TABLE 13-7

| | Manufacturing conditions | | | XPS analysis | | | TEM-EDS analysis | | | | | | |
|---|---|---|---|---|---|---|---|---|---|---|---|---|---|
| No. | Sample base sheet | Surface treatment metal agent | Application and drying conditions | XPS peak ratio | Zn concentration (mass %) | Al concentration (mass %) | Si concentration (mass %) | P concentration (mass %) | F concentration (mass %) | V concentration (mass %) | Zr concentration (mass %) | Ratio of maximum value of P concentration to average P concentration | Ratio of maximum value of F concentration to average F concentration |
| 144 | 06 | ST2 | C19 | 0.12 | 0.03 | 0.00 | 19.73 | 1.95 | 0.81 | 1.86 | 0.57 | 3.14 | 0.98 |
| 145 | 07 | ST3 | C18 | 0.16 | 0.05 | 0.00 | 18.20 | 4.33 | 0.79 | 2.47 | 0.41 | 2.06 | 1.10 |
| 146 | 01 | ST1 | C21 | 0.16 | 0.03 | 0.00 | 11.88 | 0.47 | 0.35 | 2.84 | 0.82 | 1.01 | 1.56 |
| 147 | 01 | ST2 | C20 | 0.17 | 0.02 | 0.00 | 13.82 | 4.51 | 0.62 | 0.86 | 0.22 | 1.18 | 1.88 |
| 148 | 01 | ST3 | C21 | 0.18 | 0.06 | 0.00 | 16.64 | 4.35 | 0.34 | 0.60 | 0.25 | 1.06 | 1.90 |
| 149 | 02 | ST1 | C20 | 0.25 | 0.05 | 0.00 | 16.45 | 1.13 | 0.25 | 0.52 | 0.55 | 0.93 | 2.29 |
| 150 | 03 | ST2 | C21 | 0.04 | 0.06 | 0.00 | 19.47 | 0.35 | 0.92 | 3.47 | 0.48 | 1.12 | 1.50 |
| 151 | 04 | ST3 | C20 | 0.05 | 0.03 | 0.00 | 16.12 | 1.58 | 0.67 | 1.28 | 0.62 | 0.97 | 2.21 |
| 152 | 05 | ST1 | C21 | 0.16 | 0.02 | 0.00 | 17.08 | 4.72 | 1.29 | 2.45 | 0.32 | 1.17 | 1.67 |
| 153 | 06 | ST2 | C20 | 0.07 | 0.05 | 0.00 | 12.54 | 1.42 | 1.74 | 1.88 | 0.36 | 0.91 | 1.70 |
| 154 | 07 | ST3 | C21 | 0.09 | 0.02 | 0.00 | 19.15 | 2.15 | 0.31 | 2.38 | 0.79 | 1.08 | 1.56 |
| 155 | 01 | ST1 | C22 | 0.01 | 0.06 | 0.00 | 14.42 | 2.56 | 1.46 | 1.15 | 0.44 | 1.15 | 1.55 |
| 156 | 02 | ST2 | C22 | 0.00 | 0.04 | 0.00 | 12.82 | 3.25 | 1.29 | 3.78 | 0.14 | 1.11 | 1.51 |
| 157 | 03 | ST3 | C22 | 0.01 | 0.06 | 0.00 | 18.39 | 0.11 | 0.02 | 1.40 | 0.86 | 1.11 | 1.51 |
| 158 | 04 | ST1 | C22 | 0.02 | 0.04 | 0.00 | 19.43 | 2.97 | 1.29 | 1.58 | 0.40 | 1.02 | 1.65 |
| 159 | 05 | ST2 | C22 | 0.01 | 0.06 | 0.00 | 12.18 | 0.54 | 0.46 | 1.65 | 0.27 | 1.02 | 1.65 |
| 160 | 06 | ST3 | C22 | 0.00 | 0.05 | 0.00 | 15.27 | 3.77 | 0.19 | 3.41 | 0.75 | 1.02 | 1.63 |
| 161 | 07 | ST1 | C22 | 0.02 | 0.02 | 0.00 | 18.86 | 0.19 | 1.57 | 2.14 | 0.33 | 0.92 | 1.62 |
| 162 | 01 | ST2 | C23 | 0.15 | 0.03 | 0.00 | 10.59 | 1.65 | 0.54 | 0.33 | 0.30 | 1.56 | 0.98 |
| 163 | 02 | ST3 | C23 | 0.10 | 0.03 | 0.00 | 13.32 | 4.17 | 1.46 | 3.73 | 0.43 | 1.23 | 1.07 |
| 164 | 03 | ST1 | C23 | 0.10 | 0.05 | 0.00 | 18.70 | 0.28 | 1.91 | 0.89 | 0.77 | 1.33 | 0.90 |
| 165 | 04 | ST2 | C23 | 0.23 | 0.02 | 0.00 | 16.65 | 4.51 | 0.09 | 0.61 | 0.67 | 1.80 | 1.17 |

TABLE 13-8

| | Manufacturing conditions | | | XPS analysis | | | TEM-EDS analysis | | | | | | |
|---|---|---|---|---|---|---|---|---|---|---|---|---|---|
| No. | Sample base sheet | Surface treatment metal agent | Application and drying conditions | XPS peak ratio | Zn concentration (mass %) | Al concentration (mass %) | Si concentration (mass %) | P concentration (mass %) | F concentration (mass %) | V concentration (mass %) | Zr concentration (mass %) | Ratio of maximum value of P concentration to average P concentration | Ratio of maximum value of F concentration to average F concentration |
| 166 | 05 | ST3 | C23 | 0.04 | 0.05 | 0.00 | 10.57 | 0.08 | 1.98 | 1.96 | 0.35 | 1.99 | 1.13 |
| 167 | 06 | ST1 | C23 | 0.04 | 0.06 | 0.00 | 16.74 | 2.91 | 1.39 | 3.33 | 0.53 | 1.21 | 0.94 |
| 168 | 07 | ST2 | C23 | 0.14 | 0.05 | 0.00 | 10.21 | 1.45 | 1.37 | 2.72 | 0.39 | 1.21 | 1.11 |
| 169 | 01 | ST1 | C24 | 0.16 | 0.07 | 0.00 | 17.33 | 0.71 | 0.38 | 1.65 | 0.76 | 1.80 | 2.50 |
| 170 | 02 | ST2 | C24 | 0.16 | 0.04 | 0.00 | 17.77 | 4.90 | 1.40 | 1.02 | 0.29 | 1.70 | 2.80 |
| 171 | 03 | ST3 | C24 | 0.09 | 0.04 | 0.00 | 19.82 | 2.30 | 1.22 | 3.11 | 0.51 | 1.69 | 3.01 |
| 172 | 04 | ST1 | C24 | 0.17 | 0.06 | 0.00 | 15.64 | 4.94 | 0.77 | 3.02 | 0.41 | 1.20 | 2.35 |
| 173 | 05 | ST2 | C24 | 0.19 | 0.06 | 0.00 | 14.60 | 4.73 | 1.80 | 1.35 | 0.78 | 1.60 | 2.99 |
| 174 | 06 | ST3 | C24 | 0.16 | 0.07 | 0.00 | 15.19 | 4.19 | 1.66 | 0.26 | 0.36 | 1.67 | 3.56 |
| 175 | 07 | ST3 | C24 | 0.13 | 0.07 | 0.00 | 14.30 | 0.20 | 0.09 | 3.25 | 0.71 | 1.55 | 3.24 |
| 176 | 01 | ST10 | C25 | 0.19 | 0.30 | 0.84 | 19.82 | 0.73 | 1.11 | 2.09 | 0.80 | 1.31 | 1.60 |
| 177 | 01 | ST11 | C26 | 0.12 | 0.45 | 1.65 | 19.47 | 1.51 | 1.64 | 0.69 | 0.64 | 1.56 | 1.65 |
| 178 | 01 | ST12 | C25 | 0.18 | 0.51 | 0.83 | 16.63 | 1.86 | 1.58 | 1.03 | 0.34 | 1.80 | 1.79 |

TABLE 13-8-continued

| | Manufacturing conditions | | | XPS analysis | | | TEM-EDS analysis | | | | | | |
|---|---|---|---|---|---|---|---|---|---|---|---|---|---|
| No. | Sample base sheet | Surface treatment metal agent | Application and drying conditions | XPS peak ratio | Zn concentration (mass %) | Al concentration (mass %) | Si concentration (mass %) | P concentration (mass %) | F concentration (mass %) | V concentration (mass %) | Zr concentration (mass %) | Ratio of maximum value of P concentration to average P concentration | Ratio of maximum value of F concentration to average F concentration |
| 179 | 01 | ST10 | C26 | 0.11 | 1.80 | 1.53 | 18.00 | 2.40 | 1.57 | 3.54 | 0.36 | 1.76 | 2.24 |
| 180 | 01 | ST11 | C25 | 0.04 | 1.95 | 1.73 | 19.94 | 1.51 | 0.42 | 2.90 | 0.72 | 1.90 | 2.23 |
| 181 | 01 | ST12 | C26 | 0.21 | 2.30 | 1.47 | 19.87 | 3.78 | 0.71 | 3.84 | 0.53 | 1.56 | 2.10 |
| 182 | 02 | ST10 | C25 | 0.17 | 1.30 | 0.41 | 11.47 | 1.27 | 0.31 | 0.41 | 0.40 | 1.79 | 2.10 |
| 183 | 03 | ST11 | C26 | 0.14 | 0.10 | 0.15 | 18.76 | 1.23 | 0.51 | 2.93 | 0.43 | 1.68 | 1.50 |
| 184 | 04 | ST12 | C25 | 0.10 | 3.00 | 0.32 | 15.91 | 2.59 | 0.65 | 3.10 | 0.41 | 1.54 | 1.56 |
| 185 | 05 | ST10 | C26 | 0.09 | 0.15 | 2.29 | 14.01 | 3.34 | 0.86 | 0.67 | 0.55 | 1.55 | 1.89 |
| 186 | 06 | ST11 | C25 | 0.14 | 0.25 | 2.36 | 18.39 | 0.42 | 1.29 | 3.52 | 0.40 | 1.20 | 2.30 |
| 187 | 07 | ST12 | C26 | 0.10 | 0.97 | 2.65 | 10.39 | 3.67 | 1.10 | 1.91 | 0.41 | 1.90 | 2.11 |

TABLE 13-9

| | Quality properties | | | | | | | |
|---|---|---|---|---|---|---|---|---|
| No. | Corrosion resistance (SST168h) | Corrosion resistance (SST240h) | Corrosion resistance of Erichsen processed portion | Coating adhesion | Coating adhesion after alkaline degreasing | Powdering resistance | Corrosion resistance in outdoor exposure | External appearance |
| 1 | ○ | Δ | ○ | ○ | ○ | ○ | ○ | ○ |
| 2 | ○ | Δ | ○ | ○ | ○ | ○ | ○ | ○ |
| 3 | ○ | Δ | ○ | ○ | ○ | ○ | ○ | ○ |
| 4 | ○ | Δ | ○ | ○ | ○ | ○ | ○ | ○ |
| 5 | ○ | Δ | ○ | ○ | ○ | ○ | ○ | ○ |
| 6 | ○ | Δ | ○ | ○ | ○ | ○ | ○ | ○ |
| 7 | ○ | Δ | ○ | ○ | ○ | ○ | ○ | ○ |
| 8 | ○ | Δ | ○ | ○ | ○ | ○ | ○ | ○ |
| 9 | ○ | Δ | ○ | ○ | ○ | ○ | ○ | ○ |
| 10 | ○ | Δ | ○ | ○ | ○ | ○ | ○ | ○ |
| 11 | ○ | Δ | ○ | ○ | ○ | ○ | ○ | ○ |
| 12 | ○ | Δ | ○ | ○ | ○ | ○ | ○ | ○ |
| 13 | ○ | Δ | ○ | ○ | ○ | ○ | ○ | ○ |
| 14 | ○ | Δ | ○ | ○ | ○ | ○ | ○ | ○ |
| 15 | ○ | Δ | ○ | ○ | ○ | ○ | ○ | ○ |
| 16 | ○ | Δ | ○ | ○ | ○ | ○ | ○ | ○ |
| 17 | ○ | Δ | ○ | ○ | ○ | ○ | ○ | ○ |
| 18 | ○ | Δ | ○ | ○ | ○ | ○ | ○ | ○ |
| 19 | ○ | Δ | ○ | ○ | ○ | ○ | ○ | ○ |
| 20 | ○ | Δ | ○ | ○ | ○ | ○ | ○ | ○ |
| 21 | ○ | Δ | ○ | ○ | ○ | ○ | ○ | ○ |
| 22 | Δ | x | ○ | ○ | ○ | ○ | Δ | ○ |
| 23 | Δ | x | ○ | ○ | ○ | ○ | Δ | ○ |
| 24 | x | x | ○ | ○ | ○ | ○ | x | ○ |

TABLE 13-10

| No. | Quality properties | | | | | | | |
|---|---|---|---|---|---|---|---|---|
| | Corrosion resistance (SST168h) | Corrosion resistance (SST240h) | Corrosion resistance of Erichsen processed portion | Coating adhesion | Coating adhesion after alkaline degreasing | Powdering resistance | Corrosion resistance in outdoor exposure | External appearance |
| 25 | ○ | Δ | ○ | Δ | X | ○ | ○ | ○ |
| 26 | ○ | Δ | ○ | X | X | ○ | ○ | ○ |
| 27 | ○ | Δ | ○ | X | X | ○ | ○ | ○ |
| 28 | Δ | X | ○ | ○ | ○ | ○ | Δ | ○ |
| 29 | ○ | Δ | ○ | Δ | X | ○ | ○ | ○ |
| 30 | ○ | Δ | ○ | ○ | ◎ | ○ | ○ | ○ |
| 31 | ○ | Δ | ○ | ○ | ◎ | ○ | ○ | ○ |
| 32 | ○ | Δ | ○ | ○ | ◎ | ○ | ○ | ○ |
| 33 | ○ | Δ | ○ | ○ | ◎ | ○ | ○ | ○ |
| 34 | ○ | Δ | ○ | ○ | ◎ | ○ | ○ | ○ |
| 35 | ○ | Δ | ○ | ○ | ◎ | ○ | ○ | ○ |
| 36 | ○ | Δ | ○ | ○ | ◎ | ○ | ○ | ○ |
| 37 | ○ | Δ | ○ | ○ | ◎ | ○ | ○ | ○ |
| 38 | ○ | Δ | ○ | ○ | ◎ | ○ | ○ | ○ |
| 39 | ○ | Δ | ○ | ○ | ◎ | ○ | ○ | ○ |
| 40 | ○ | Δ | ○ | ○ | ◎ | ○ | ○ | ○ |
| 41 | ○ | Δ | ○ | ○ | ◎ | ○ | ○ | ○ |
| 42 | ○ | Δ | ○ | ○ | ◎ | ○ | ○ | ○ |
| 43 | ○ | Δ | ○ | ○ | ◎ | ○ | ○ | ○ |
| 44 | ○ | Δ | ○ | ○ | ◎ | ○ | ○ | ○ |
| 45 | Δ | X | ○ | ○ | ◎ | ○ | Δ | ○ |
| 46 | Δ | X | ○ | ○ | ◎ | ○ | Δ | ○ |
| 47 | X | X | ○ | ○ | ◎ | ○ | X | ○ |
| 48 | ○ | Δ | ○ | Δ | Δ | ○ | ○ | ○ |

TABLE 13-11

| No. | Quality properties | | | | | | | |
|---|---|---|---|---|---|---|---|---|
| | Corrosion resistance (SST168h) | Corrosion resistance (SST240h) | Corrosion resistance of Erichsen processed portion | Coating adhesion | Coating adhesion after alkaline degreasing | Powdering resistance | Corrosion resistance in outdoor exposure | External appearance |
| 49 | ○ | Δ | ○ | X | X | ○ | ○ | ○ |
| 50 | ○ | Δ | ○ | X | X | ○ | ○ | ○ |
| 51 | Δ | X | ○ | ○ | ◎ | ○ | Δ | ○ |
| 52 | ○ | Δ | ○ | Δ | Δ | ○ | ○ | ○ |
| 53 | ○ | Δ | ○ | ○ | ○ | ○ | ◎ | ○ |
| 54 | ○ | Δ | ○ | ○ | ○ | ○ | ◎ | ○ |
| 55 | ○ | Δ | ○ | ○ | ○ | ○ | ◎ | ○ |
| 56 | ○ | Δ | ○ | ○ | ○ | ○ | ◎ | ○ |
| 57 | ○ | Δ | ○ | ○ | ○ | ○ | ◎ | ○ |
| 58 | ○ | Δ | ○ | ○ | ○ | ○ | ◎ | ○ |
| 59 | ○ | Δ | ○ | ○ | ○ | ○ | ◎ | ○ |
| 60 | ○ | Δ | ○ | ○ | ○ | ○ | ◎ | ○ |
| 61 | ○ | Δ | ○ | ○ | ○ | ○ | ◎ | ○ |
| 62 | ○ | Δ | ○ | ○ | ○ | ○ | ◎ | ○ |
| 63 | ○ | Δ | ○ | ○ | ○ | ○ | ◎ | ○ |
| 64 | ○ | Δ | ○ | ○ | ○ | ○ | ◎ | ○ |
| 65 | ○ | Δ | ○ | ○ | ○ | ○ | ◎ | ○ |
| 66 | ○ | Δ | ○ | ○ | ○ | ○ | ◎ | ○ |
| 67 | ○ | Δ | ○ | ○ | ○ | ○ | ◎ | ○ |
| 68 | Δ | X | ○ | ○ | ○ | ○ | Δ | ○ |
| 69 | Δ | X | ○ | ○ | ○ | ○ | Δ | ○ |
| 70 | X | X | ○ | ○ | ○ | ○ | X | ○ |
| 71 | ○ | Δ | ○ | Δ | X | ○ | ◎ | ○ |
| 72 | ○ | Δ | ○ | X | X | ○ | ◎ | ○ |

TABLE 13-12

| No. | Quality properties | | | | | | | |
|---|---|---|---|---|---|---|---|---|
| | Corrosion resistance (SST168h) | Corrosion resistance (SST240h) | Corrosion resistance of Erichsen processed portion | Coating adhesion | Coating adhesion after alkaline degreasing | Powdering resistance | Corrosion resistance in outdoor exposure | External appearance |
| 73 | ○ | Δ | ○ | X | X | ○ | ◎ | ○ |
| 74 | Δ | X | ○ | ○ | ○ | ○ | Δ | ○ |
| 75 | ○ | Δ | ○ | Δ | X | ○ | ◎ | ○ |
| 76 | ○ | Δ | ○ | ○ | ◎ | ○ | ◎ | ○ |
| 77 | ○ | Δ | ○ | ○ | ◎ | ○ | ◎ | ○ |
| 78 | ○ | Δ | ○ | ○ | ◎ | ○ | ◎ | ○ |
| 79 | ○ | Δ | ○ | ○ | ◎ | ○ | ◎ | ○ |
| 80 | ○ | Δ | ○ | ○ | ◎ | ○ | ◎ | ○ |
| 81 | ○ | Δ | ○ | ○ | ◎ | ○ | ◎ | ○ |
| 82 | ○ | Δ | ○ | ○ | ◎ | ○ | ◎ | ○ |
| 83 | ○ | Δ | ○ | ○ | ◎ | ○ | ◎ | ○ |
| 84 | ○ | Δ | ○ | ○ | ◎ | ○ | ◎ | ○ |
| 85 | ○ | Δ | ○ | ○ | ◎ | ○ | ◎ | ○ |
| 86 | ○ | Δ | ○ | ○ | ◎ | ○ | ◎ | ○ |
| 87 | ○ | Δ | ○ | ○ | ◎ | ○ | ◎ | ○ |
| 88 | ○ | Δ | ○ | ○ | ◎ | ○ | ◎ | ○ |
| 89 | ○ | Δ | ○ | ○ | ◎ | ○ | ◎ | ○ |
| 90 | ○ | Δ | ○ | ○ | ◎ | ○ | ◎ | ○ |
| 91 | Δ | X | ○ | ○ | ◎ | ○ | Δ | ○ |
| 92 | Δ | X | ○ | ○ | ◎ | ○ | Δ | ○ |
| 93 | X | X | ○ | ○ | ◎ | ○ | X | ○ |
| 94 | ○ | Δ | ○ | Δ | Δ | ○ | ◎ | ○ |
| 95 | ○ | Δ | ○ | X | X | ○ | ◎ | ○ |
| 96 | ○ | Δ | ○ | X | X | ○ | ◎ | ○ |

TABLE 13-13

| No. | Quality properties | | | | | | | |
|---|---|---|---|---|---|---|---|---|
| | Corrosion resistance (SST168h) | Corrosion resistance (SST240h) | Corrosion resistance of Erichsen processed portion | Coating adhesion | Coating adhesion after alkaline degreasing | Powdering resistance | Corrosion resistance in outdoor exposure | External appearance |
| 97 | Δ | X | ○ | ○ | ◎ | ○ | Δ | ○ |
| 98 | ○ | Δ | ○ | Δ | X | ○ | ◎ | ○ |
| 99 | Δ | X | ○ | ○ | ○ | ○ | ○ | ○ |
| 100 | Δ | X | ○ | ○ | ○ | ○ | ○ | ○ |
| 101 | Δ | X | ○ | ○ | ○ | ○ | ○ | ○ |
| 102 | Δ | X | ○ | ○ | ○ | ○ | Δ | ○ |
| 103 | Δ | X | ○ | ○ | ○ | ○ | Δ | ○ |
| 104 | Δ | X | ○ | ○ | ○ | ○ | Δ | ○ |
| 105 | Δ | X | ○ | ○ | ◎ | ○ | Δ | ○ |
| 106 | Δ | X | ○ | Δ | Δ | X | Δ | ○ |
| 107 | Δ | X | ○ | Δ | Δ | X | Δ | ○ |
| 108 | ○ | Δ | ○ | ○ | ◎ | X | ○ | ○ |
| 109 | ○ | Δ | ○ | ○ | ◎ | X | ○ | ○ |
| 110 | ○ | Δ | ○ | ○ | ◎ | X | ○ | ○ |
| 111 | ○ | Δ | ○ | ○ | ◎ | ○ | ○ | ○ |
| 112 | ○ | Δ | ○ | ○ | ◎ | ○ | ○ | ○ |
| 113 | ○ | Δ | ○ | ○ | ◎ | ○ | ○ | ○ |
| 114 | ○ | Δ | ○ | ○ | ◎ | ○ | ◎ | X |
| 115 | ○ | Δ | ○ | ○ | ◎ | ○ | ◎ | X |
| 116 | ○ | Δ | ○ | ○ | ◎ | ○ | ◎ | X |
| 117 | Δ | X | ○ | ○ | ○ | ○ | ○ | ○ |
| 118 | Δ | X | ○ | ○ | ○ | ○ | ○ | ○ |
| 119 | Δ | X | ○ | ○ | ○ | ○ | Δ | ○ |
| 120 | X | X | ○ | ○ | ○ | ○ | Δ | ○ |

TABLE 13-14

| No. | Quality properties | | | | | | | |
|---|---|---|---|---|---|---|---|---|
| | Corrosion resistance (SST168h) | Corrosion resistance (SST240h) | Corrosion resistance of Erichsen processed portion | Coating adhesion | Coating adhesion after alkaline degreasing | Powdering resistance | Corrosion resistance in outdoor exposure | External appearance |
| 121 | Δ | x | ○ | ○ | ○ | ○ | Δ | ○ |
| 122 | x | x | ○ | ○ | ○ | ○ | x | ○ |
| 123 | Δ | x | ○ | ○ | ○ | ○ | Δ | ○ |
| 124 | x | x | ○ | ○ | ○ | ○ | x | ○ |
| 125 | Δ | x | ○ | ○ | ○ | ○ | x | ○ |
| 126 | x | x | ○ | ○ | ○ | ○ | x | ○ |
| 127 | Δ | x | ○ | ○ | ○ | ○ | Δ | ○ |
| 128 | ○ | ○ | ○ | ○ | ○ | ○ | ○ | ○ |
| 129 | ○ | ○ | ○ | ○ | ○ | ○ | ○ | ○ |
| 130 | ○ | ○ | ○ | ○ | ○ | ○ | ○ | ○ |
| 131 | ○ | ○ | ○ | ○ | ○ | ○ | ○ | ○ |
| 132 | ○ | ○ | ○ | ○ | ○ | ○ | ○ | ○ |
| 133 | ○ | ○ | ○ | ○ | ○ | ○ | ○ | ○ |
| 134 | ○ | ○ | ○ | ○ | ○ | ○ | ○ | ○ |
| 135 | ○ | ○ | ○ | ○ | ○ | ○ | ○ | ○ |
| 136 | ○ | ○ | ○ | ○ | ○ | ○ | ○ | ○ |
| 137 | ○ | Δ | Δ | ○ | Δ | ○ | ○ | ○ |
| 138 | ○ | Δ | Δ | ○ | Δ | ○ | ○ | ○ |
| 139 | ○ | Δ | Δ | ○ | Δ | ○ | ○ | ○ |
| 140 | ○ | Δ | x | ○ | Δ | ○ | ○ | ○ |
| 141 | ○ | Δ | Δ | ○ | Δ | ○ | ○ | ○ |
| 142 | ○ | Δ | Δ | ○ | Δ | ○ | ○ | ○ |
| 143 | ○ | Δ | x | ○ | Δ | ○ | ○ | ○ |

TABLE 13-15

| No. | Quality properties | | | | | | | |
|---|---|---|---|---|---|---|---|---|
| | Corrosion resistance (SST168h) | Corrosion resistance (SST240h) | Corrosion resistance of Erichsen processed portion | Coating adhesion | Coating adhesion after alkaline degreasing | Powdering resistance | Corrosion resistance in outdoor exposure | External appearance |
| 144 | ○ | Δ | Δ | ○ | Δ | ○ | ○ | ○ |
| 145 | ○ | Δ | Δ | ○ | Δ | ○ | ○ | ○ |
| 146 | ○ | ○ | ○ | ○ | ○ | ○ | ○ | ○ |
| 147 | ○ | ○ | ○ | ○ | ○ | ○ | ○ | ○ |
| 148 | ○ | ○ | ○ | ○ | ○ | ○ | ○ | ○ |
| 149 | ○ | ○ | ○ | ○ | ○ | ○ | ○ | ○ |
| 150 | ○ | ○ | ○ | ○ | ○ | ○ | ○ | ○ |
| 151 | ○ | ○ | ○ | ○ | ○ | ○ | ○ | ○ |
| 152 | ○ | ○ | ○ | ○ | ○ | ○ | ○ | ○ |
| 153 | ○ | ○ | ○ | ○ | ○ | ○ | ○ | ○ |
| 154 | ○ | ○ | ○ | ○ | ○ | ○ | ○ | ○ |
| 155 | Δ | x | ○ | ○ | ○ | ○ | x | ○ |
| 156 | Δ | x | ○ | ○ | ○ | ○ | x | ○ |
| 157 | Δ | x | ○ | ○ | ○ | ○ | x | ○ |
| 158 | Δ | x | ○ | ○ | ○ | ○ | x | ○ |
| 159 | Δ | x | ○ | ○ | ○ | ○ | x | ○ |
| 160 | Δ | x | ○ | ○ | ○ | ○ | x | ○ |
| 161 | x | x | ○ | ○ | ○ | ○ | x | ○ |
| 162 | ○ | ○ | ○ | ○ | ○ | ○ | ○ | ○ |
| 163 | ○ | ○ | ○ | ○ | ○ | ○ | ○ | ○ |
| 164 | ○ | ○ | ○ | ○ | ○ | ○ | ○ | ○ |
| 165 | ○ | ○ | ○ | ○ | ○ | ○ | ○ | ○ |

TABLE 13-16

| No. | Quality properties | | | | | | | |
|---|---|---|---|---|---|---|---|---|
| | Corrosion resistance (SST168h) | Corrosion resistance (SST240h) | Corrosion resistance of Erichsen processed portion | Coating adhesion | Coating adhesion after alkaline degreasing | Powdering resistance | Corrosion resistance in outdoor exposure | External appearance |
| 166 | ○ | ○ | ○ | ○ | ○ | ○ | ○ | ○ |
| 167 | ○ | ○ | ○ | ○ | ○ | ○ | ○ | ○ |
| 168 | ○ | ○ | ○ | ○ | ○ | ○ | ○ | ○ |
| 169 | ○ | ○ | X | ○ | X | ○ | ○ | ○ |
| 170 | ○ | ○ | Δ | ○ | Δ | ○ | ○ | ○ |
| 171 | ○ | ○ | Δ | ○ | Δ | ○ | ○ | ○ |
| 172 | ○ | ○ | Δ | ○ | X | ○ | ○ | ○ |
| 173 | ○ | ○ | Δ | ○ | Δ | ○ | ○ | ○ |
| 174 | ○ | ○ | Δ | ○ | Δ | ○ | ○ | ○ |
| 175 | ○ | ○ | X | ○ | X | ○ | ○ | ○ |
| 176 | ○ | ○ | ○ | ○ | ◎ | ○ | ◎ | ○ |
| 177 | ○ | ○ | ○ | ○ | ◎ | ○ | ◎ | ○ |
| 178 | ○ | ○ | ○ | ○ | ◎ | ○ | ◎ | ○ |
| 179 | ○ | ○ | ○ | ○ | ◎ | ○ | ◎ | ○ |
| 180 | ○ | ○ | ○ | ○ | ◎ | ○ | ◎ | ○ |
| 181 | ○ | ○ | ○ | ○ | ◎ | ○ | ◎ | ○ |
| 182 | ○ | ○ | ○ | ○ | ◎ | ○ | ◎ | ○ |
| 183 | ○ | ○ | ○ | ○ | ◎ | ○ | ◎ | ○ |
| 184 | ○ | ○ | ○ | ○ | ◎ | ○ | ◎ | ○ |
| 185 | ○ | ○ | ○ | ○ | ◎ | ○ | ◎ | ○ |
| 186 | ○ | ○ | ○ | ○ | ◎ | ○ | ◎ | ○ |
| 187 | ○ | ○ | ○ | ○ | ◎ | ○ | ◎ | ○ |

As can be seen from Tables 1 to 13-16, the surface-treated steel sheet Nos. 1 to 21, 30 to 44, 53 to 67, 76 to 90, 108 to 113, 128 to 154, and 162 to 187, which are present invention examples, were excellent in corrosion resistance and coating adhesion. Particularly in Nos. 30 to 44, 76 to 90, 108 to 113, and 176 to 187, the Zn concentration on the surface of the coating was high, and the alkali resistance was also excellent. In addition, particularly in Nos. 53 to 67, 76 to 90, and 176 to 187, the Al concentration on the surface of the coating was high, and the corrosion resistance in an outdoor exposure environment was also excellent.

In addition, particularly in Nos. 128 to 136, 146 to 154, and 162 to 187, an appropriate P-enriched layer and/or F-enriched layer was formed in the coating, and excellent corrosion resistance was exhibited even in the SST test after 240 hours.

On the other hand, Nos. 21 to 29, 45 to 52, 68 to 75, 91 to 107, 114 to 127, and 155 to 161, which are comparative examples, were inferior in either corrosion resistance or coating adhesion, or deteriorated in external appearance, and thus were not suitable for use.

BRIEF DESCRIPTION OF THE REFERENCE SYMBOLS

1 Surface-treated steel sheet

11 Steel sheet

12 Zn-based plating layer

13 Coating

INDUSTRIAL APPLICABILITY

According to the present invention, it is possible to provide a surface-treated steel sheet having excellent corrosion resistance and coating adhesion. Therefore, high industrial applicability is achieved.

What is claimed is:

1. A surface-treated steel sheet comprising:

a steel sheet;

a Zn-based plating layer formed on the steel sheet; and a coating formed on the Zn-based plating layer, wherein a Si concentration, a P concentration, a F concentration, a V concentration, a Zr concentration, a Zn concentration, and an Al concentration of the coating are, by mass %, Si: 10.00% to 25.00%, P: 0.01% to 5.00%, F: 0.01% to 2.00%, V: 0.01% to 4.00%, Zr: 0.01% to 3.00%, Zn: 0% to 3.00%, and Al: 0% to 3.00%, in a narrow spectrum of Si2p obtained by performing XPS analysis on a surface of the coating, a ratio of an integrated intensity of a peak having a local maximum value at 103.37±0.25 eV to an integrated intensity of a peak having a local maximum value at 102.26±0.25 eV is 0.04 or more and 0.25 or less.

2. The surface-treated steel sheet according to claim 1, wherein, in the surface of the coating, the Zn concentration is 0.10% to 3.00% by mass %.

3. The surface-treated steel sheet according to claim 1, wherein, in the surface of the coating, the Al concentration is 0.10% to 3.00% by mass %.

4. The surface-treated steel sheet according to claim 1, wherein the coating has a P-enriched layer having a P concentration higher than an average P concentration in a range from the surface of the coating to an interface between the coating and the Zn-based plating layer in a thickness direction of the steel sheet, the P-enriched layer is present adjacent to the interface with the Zn-based plating layer, and when line analysis of TEM-EDS is performed on a cross section in the thickness direction to obtain the P concentration from the surface of the coating to the interface between the coating and the Zn-based plating layer, a ratio of a maximum value of the P concentration to the average P concentration is 1.20 to 2.00.

5. The surface-treated steel sheet according to claim 1, wherein the coating has a F-enriched layer having a F concentration higher than an average F concentration in a range from the surface of the coating to an interface between the coating and the Zn-based plating layer in a thickness direction of the steel sheet, the F-enriched layer is present adjacent to the interface with the Zn-based plating layer, and when line analysis of TEM-EDS is performed on a cross section in the thickness direction to obtain the F concentration from the surface of the coating to the interface between the coating and the Zn-based plating layer, a ratio of a maximum value of the F concentration to the average F concentration is 1.50 to 2.30.

6. The surface-treated steel sheet according to claim 1, wherein the Zn-based plating layer contains, as a chemical composition, by mass %, Al: 4.0% to less than 25.0%,
Mg: 0% to less than 12.5%,
Sn: 0% to 20%,
Bi: 0% to less than 5.0%,
In: 0% to less than 2.0%,
Ca: 0% to 3.0%,
Y: 0% to 0.5%,
La: 0% to less than 0.5%,
Ce: 0% to less than 0.5%,
Si: 0% to less than 2.5%,
Cr: 0% to less than 0.25%,
Ti: 0% to less than 0.25%,
Ni: 0% to less than 0.25%,
Co: 0% to less than 0.25%,
V: 0% to less than 0.25%,
Nb: 0% to less than 0.25%,
Cu: 0% to less than 0.25%,
Mn: 0% to less than 0.25%,
Fe: 0% to 5.0%,
Sr: 0% to less than 0.5%,
Sb: 0% to less than 0.5%,
Pb: 0% to less than 0.5%,
B: 0% to less than 0.5%, and
a remainder: Zn and impurities.

* * * * *